US012006953B2

(12) United States Patent
Hakuta et al.

(10) Patent No.: US 12,006,953 B2
(45) Date of Patent: Jun. 11, 2024

(54) BLOWER WITH SILENCER

(71) Applicant: FUJIFILM Corporation, Tokyo (JP)

(72) Inventors: Shinya Hakuta, Ashigarakami-gun (JP); Shogo Yamazoe, Ashigarakami-gun (JP); Yoshihiro Sugawara, Ashigarakami-gun (JP); Akihiko Ohtsu, Ashigarakami-gun (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 17/886,556

(22) Filed: Aug. 12, 2022

(65) Prior Publication Data

US 2022/0389938 A1 Dec. 8, 2022

Related U.S. Application Data

(63) Continuation of application No. PCT/JP2021/004853, filed on Feb. 10, 2021.

(30) Foreign Application Priority Data

Mar. 26, 2020 (JP) ..... 2020-055261

(51) Int. Cl.
*F04D 29/66* (2006.01)
*F04D 19/00* (2006.01)
*F04D 29/54* (2006.01)

(52) U.S. Cl.
CPC ..... *F04D 29/665* (2013.01); *F04D 19/002* (2013.01); *F04D 29/542* (2013.01)

(58) Field of Classification Search
CPC .... F04D 29/665; F04D 19/002; F04D 29/542; F04D 29/663; F04D 29/664; G10K 11/172
See application file for complete search history.

(56) References Cited

U.S. PATENT DOCUMENTS 6,390,770 B1 5/2002 Takeshita
10,655,538 B2 * 5/2020 Gilson ..... F04D 29/667
(Continued)

FOREIGN PATENT DOCUMENTS

JP 4-265500 A 9/1992
JP 04265500 A * 9/1992
(Continued)

OTHER PUBLICATIONS

International Preliminary Report on Patentability and Written Opinion of the International Searching Authority for International Application No. PCT/JP2021/004853, dated Oct. 6, 2022, with an English translation.

(Continued)

*Primary Examiner* — Topaz L. Elliott
*Assistant Examiner* — Ryan C Clark
(74) *Attorney, Agent, or Firm* — Birch, Stewart, Kolasch & Birch, LLP

(57) ABSTRACT

An axial fan that includes a casing having an inner space that penetrates in one direction, and a rotor blade disposed in the inner space of the casing, and a silencer that is disposed at a position connected to the inner space of the axial fan are provided, in which the axial fan has a sound pressure distribution having a position at which a sound pressure is high and a position at which the sound pressure is low in a circumferential direction in the inner space during driving, and the silencer is disposed at the position of the axial fan in the circumferential direction at which the sound pressure is high and is not disposed at the position at which the sound pressure is low.

17 Claims, 18 Drawing Sheets

(56) References Cited

U.S. PATENT DOCUMENTS

| | | | | |
|---|---|---|---|---|
| 2003/0183446 | A1* | 10/2003 | Shah | F15D 1/02 181/205 |
| 2009/0308685 | A1* | 12/2009 | Gorny | F04D 29/665 181/205 |
| 2016/0017895 | A1* | 1/2016 | Chang | F04D 29/663 415/119 |
| 2016/0061220 | A1* | 3/2016 | Stanley | F04D 29/582 415/169.2 |
| 2016/0238033 | A1* | 8/2016 | Fang | F04D 25/0606 |
| 2017/0227020 | A1* | 8/2017 | Arima | F04D 25/0613 |
| 2017/0234330 | A1* | 8/2017 | Kelaher | F04D 19/002 415/1 |
| 2020/0149535 | A1* | 5/2020 | Takemoto | F04D 19/002 |
| 2020/0208646 | A1* | 7/2020 | Tokuno | F04D 29/666 |

FOREIGN PATENT DOCUMENTS

| | | | |
|---|---|---|---|
| JP | 7-189999 | A | 7/1995 |
| JP | 10-306972 | A | 11/1998 |
| JP | 2005-248734 | A | 9/2005 |
| WO | WO99/66210 | A1 | 12/1999 |

OTHER PUBLICATIONS

International Search Report for International Application No. PCT/JP2021/004853, dated Apr. 13, 2021, with an English translation.
Japanese Office Action for corresponding Japanese Application No. 2022-509373, dated Sep. 26, 2023, with English translation.

* cited by examiner

BLOWER WITH SILENCER

CROSS-REFERENCE TO RELATED APPLICATIONS

This application is a Continuation of PCT International Application No. PCT/JP2021/004853 filed on Feb. 10, 2021, which claims priority under 35 U.S.C. § 119(a) to Japanese Patent Application No. 2020-055261 filed on Mar. 26, 2020. Each of the above application(s) is hereby expressly incorporated by reference, in its entirety, into the present application.

BACKGROUND OF THE INVENTION

1. Field of the Invention

The present invention relates to a blower with a silencer.

2. Description of the Related Art

In an information device, such as a personal computer (PC), a duplicator, and the like, in order to cool an inside of the device, an axial fan is used to exhaust heated air in the device.

Out of a noise generated from such a cooling axial fan, a noise of which a frequency is determined by the number of blades and a rotation speed thereof has a high sound pressure at a specific frequency and a very strong pure tone (tone) component, which is jarring and causes a problem.

In order to reduce such noise, even in a case in which a porous sound absorbing material generally used for silencing is used, sound volume is uniformly reduced in a wide frequency band. Therefore, in a case in which the sound pressure is high only at a specific frequency as described above, it is difficult to relatively lower the sound pressure of a specific frequency. In addition, in a case in which the porous sound absorbing material is used, it is necessary to increase a volume thereof in order to obtain a sufficient silencing effect, but since it is necessary to ensure an air volume due to a fan, there is a problem in which a size of the porous sound absorbing material is limited, and thus it is difficult to achieve both high ventilation property and soundproofing performance.

In order to silence such noise of the fan generated at a specific frequency, it has been proposed to use a resonance type silencer.

For example, JP2005-248734A a fan device including a blade member that is rotatably provided, a flow passage of gas for causing gas to flow into an inside by rotation of the blade member and causing the inflow gas to flow to an outside, an inclined surface for expanding the flow passage to the outside, and a casing having a recess portion provided on the inclined surface. JP2005-248734A discloses that the fan device resonates a sound with air in the recess portion to subject the sound to resonance absorption.

SUMMARY OF THE INVENTION

Here, according to the examination by the present inventors, it has been found that, in a case in which the resonator is disposed inside the axial fan, the sound may be amplified and may not be appropriately silenced depending on the disposition position.

The present invention is to solve the problems in the related art described above, and to provide a blower with a silencer that suppresses the amplification of the sound in a case in which the resonator is disposed inside the axial fan and can suitably silence the sound.

The present invention solves the problems by following configurations.

[1] A blower with a silencer, the blower comprising an axial fan that includes a casing having an inner space that penetrates in one direction, and a rotor blade disposed in the inner space of the casing, and a silencer that is disposed at a position connected to the inner space of the axial fan, in which the axial fan has a sound pressure distribution having a position at which a sound pressure is high and a position at which the sound pressure is low in a circumferential direction in the inner space during driving, and the silencer is connected to the position of the axial fan in the circumferential direction at which the sound pressure is high and is not connected to the position at which the sound pressure is low.

[2] The blower with a silencer according to [1], in which the silencer is a resonator.

[3] The blower with a silencer according to [2], in which the resonator has a flow passage communicating with the inner space of the axial fan.

[4] The blower with a silencer according to [2] or [3], in which, in a case in which a resonance frequency of the resonator is denoted by $f_0$ and at least one frequency of a discrete frequency sound caused by the rotor blade of the axial fan is denoted by $f_n$, the resonance frequency $f_0$ of the resonator is in a range of $0.8 \times f_n$ to $1.1 \times f_n$.

[5] The blower with a silencer according to [4], in which, in a case in which the resonance frequency of the resonator is denoted by $f_0$ and at least one frequency of the discrete frequency sound caused by the rotor blade of the axial fan is denoted by $f_n$, the resonance frequency $f_0$ of the resonator is in a range of $0.9 \times f_n$ to $0.95 \times f_n$.

[6] The blower with a silencer according to [5], in which the resonator having the resonance frequency $f_0$ in the range of $0.8 \times f_n$ to $1.1 \times f_n$ with respect to each of two or more discrete frequency sounds is provided.

[7] The blower with a silencer according to any one of [1] to [6], in which the silencer is disposed at a position that does not overlap with a region formed by rotation of the rotor blade as viewed from an axial direction of the axial fan.

[8] The blower with a silencer according to any one of [1] to [7], in which the silencer is disposed at each of two or more positions at which the sound pressure is high in the sound pressure distribution of at least one discrete frequency sound caused by the rotor blade of the axial fan in the circumferential direction.

[9] The blower with a silencer according to any one of [1] to [8], in which the axial fan has a fixed blade.

[10] The blower with a silencer according to [9], in which the silencer is disposed at the position at which the sound pressure is high and is not disposed at the position at which the sound pressure is low in the sound pressure distribution in a fixed blade opening portion between the fixed blades in the circumferential direction.

[11] The blower with a silencer according to [10], in which the silencer is disposed in all the fixed blade opening portions.

[12] The blower with a silencer according to [10] or [11], in which at least one silencer is disposed at a position within 25% of a distance between the fixed blades, from the fixed blade.

[13] The blower with a silencer according to any one of [10] to [12], in which the number of blades of the rotor blade is more than the number of blades of the fixed blade.

According to the present invention, it is possible to provide a blower with a silencer that suppresses the amplification of a sound in a case in which a resonator is disposed inside an axial fan and can suitably silence the sound.

DESCRIPTION OF THE PREFERRED EMBODIMENTS

The present invention will be described below in detail.

The description of configuration elements described below is based on a representative embodiment of the present invention, but the present invention is not limited to such an embodiment.

Note that in the present specification, the numerical range represented by "to" means a range including numerical values denoted before and after "to" as a lower limit value and an upper limit value.

[Blower with Silencer]

An embodiment of the present invention relates to a blower with a silencer, the blower including an axial fan that includes a casing having an inner space that penetrates in one direction, and a rotor blade disposed in the inner space of the casing, and a silencer that is disposed at a position connected to the inner space of the axial fan, in which the axial fan has a sound pressure distribution having a position at which a sound pressure is high and a position at which the sound pressure is low in a circumferential direction in the inner space during driving, and the silencer is connected to the position of the axial fan in the circumferential direction at which the sound pressure is high and is not connected to the position at which the sound pressure is low.

A configuration of the blower with the silencer according to the embodiment of the present invention will be described with reference to drawings.

Figure 1:
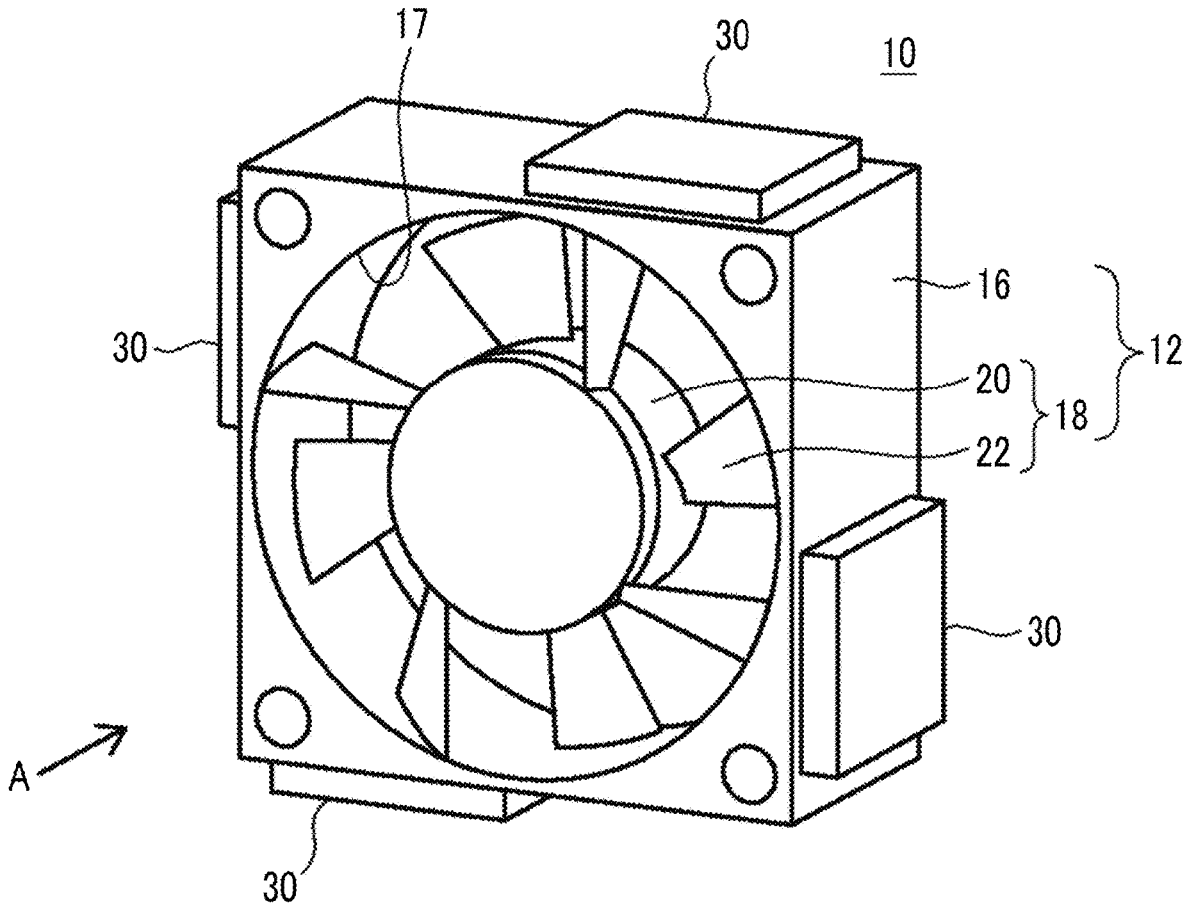
FIG. 1 is a perspective view schematically showing an example of a blower with a silencer according to an embodiment of the present invention.
Figure 2:
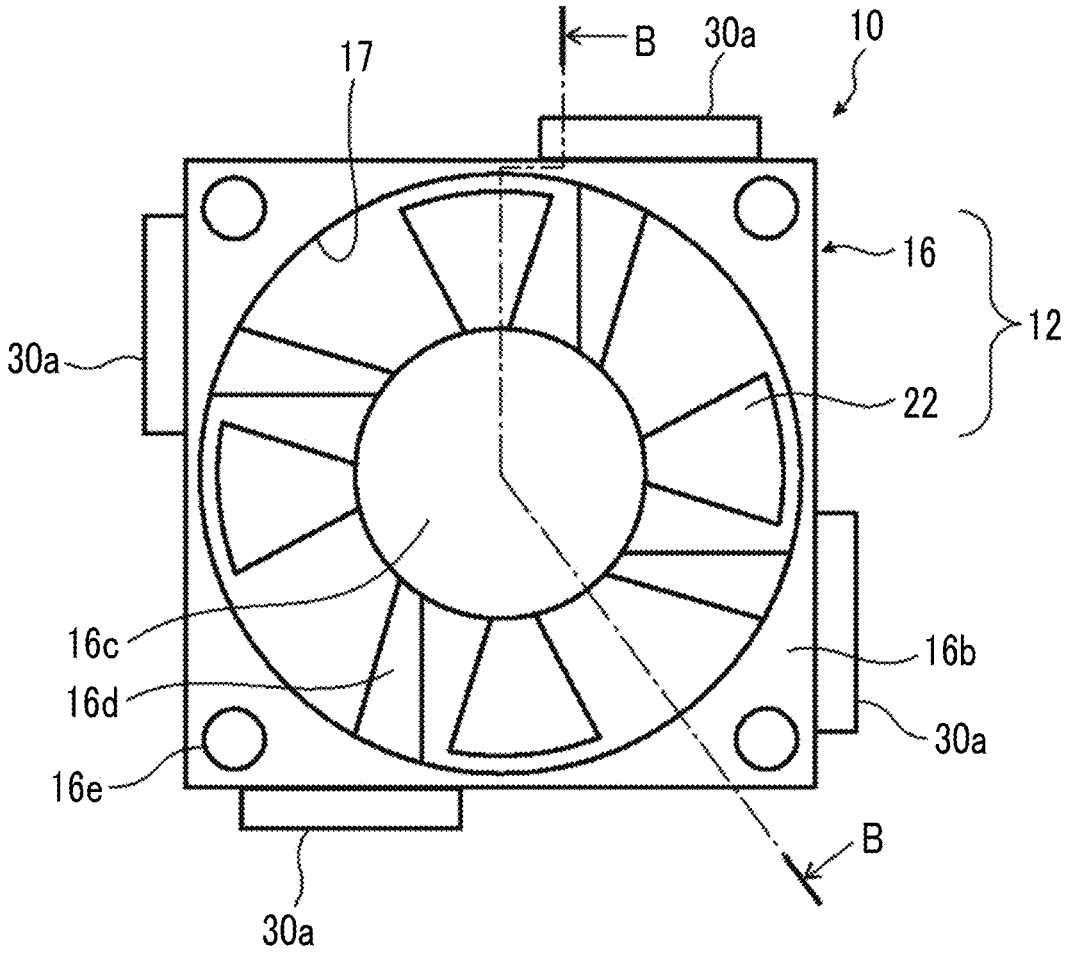
FIG. 2 is a front view of the blower with the silencer of FIG. 1 as viewed from an A direction.
Figure 3:
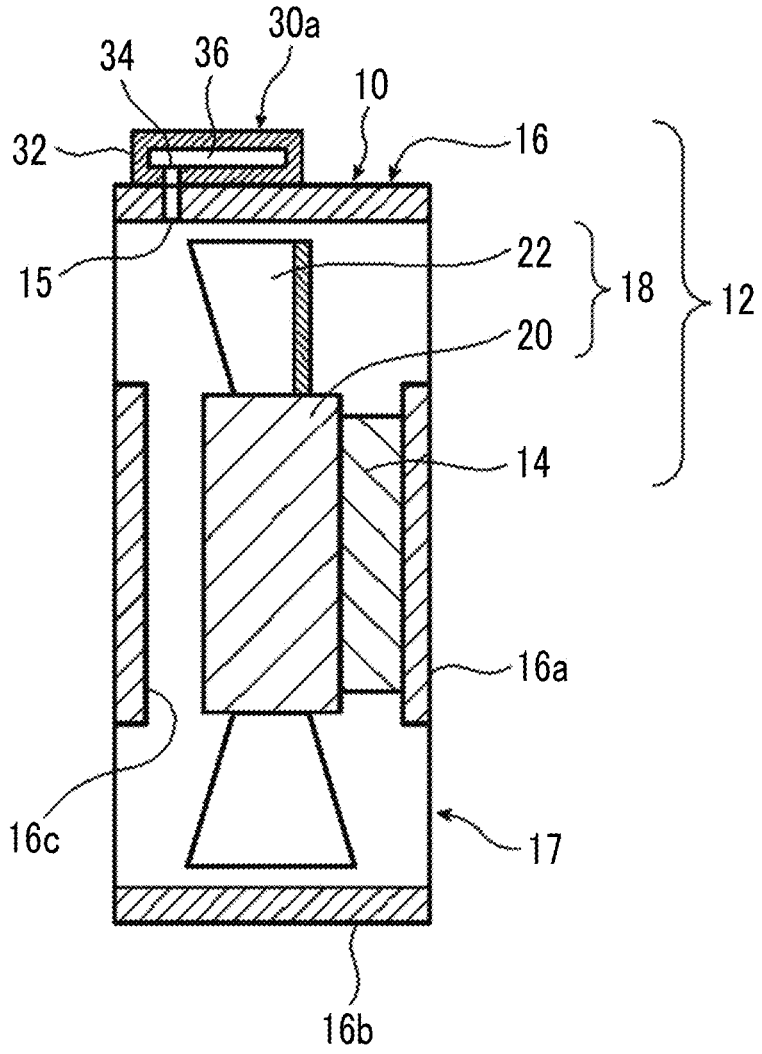
FIG. 3 is a cross-sectional view taken along a line B-B of FIG. 2.

FIG. 1 is a perspective view schematically showing an example of the blower with the silencer according to a preferred embodiment of the present invention. FIG. 2 is a front view of FIG. 1 as viewed from an A direction. FIG. 3 is a cross-sectional view taken along a line B-B of FIG. 2.

A blower 10 with the silencer shown in FIGS. 1 to 3 includes an axial fan 12 having a casing 16, a motor 14, and a rotor blade 18, and a silencer 30.

The axial fan 12 is basically a known axial fan, and rotates a rotor blade having a plurality of blades to impart kinetic energy to a gas to blow the gas in an axial direction.

Specifically, the axial fan 12 includes the casing 16, the motor 14 attached to the casing 16, and the rotor blade 18 comprising a shaft portion 20 attached to the motor 14 and rotated, and a blade 22 formed to protrude to an outside of the shaft portion 20 in a radial direction.

Note that in the following description, a rotation axis of the shaft portion 20 (rotor blade 18) is simply referred to as the "rotation axis", and the radial direction from the shaft portion 20 (rotor blade 18) is simply referred to as the "radial direction". In addition, a rotation direction of the rotor blade 18 is also referred to as "circumferential direction".

The motor 14 is a general electric motor which rotates the rotor blade 18.

The shaft portion 20 of the rotor blade 18 has a substantially columnar shape, and one bottom surface side thereof is attached to a rotation shaft of the motor 14, and the rotor blade 18 is rotated by the motor 14.

The blade 22 is formed on a circumferential surface of the shaft portion 20 to protrude an outer side of the circumferential surface in the radial direction. In addition, the rotor blade 18 has a plurality of blades 22, and the plurality of blades 22 are arranged in a circumferential direction of the circumferential surface of the shaft portion 20. In examples shown in FIGS. 1 to 3, the rotor blade 18 has a configuration having four blades 22, but the present invention is not limited to this, and the rotor blade 18 need only have the plurality of blades 22.

In addition, a shape of the blade 22 can be a shape used in a known axial fan in the related art.

The thickness of the blade 22 in the rotation axis direction is about 5 mm to 200 mm. In addition, the thickness of the shaft portion 20 is about 5 mm to 200 mm. In addition, it is preferable that the maximum value of the thickness of the blade 22 in the rotation axis direction and the thickness of the shaft portion 20 be substantially the same.

In addition, a diameter of the shaft portion 20 is about 10 mm to 1500 mm. In addition, an outer diameter of the rotor blade 18, that is, an outer diameter of the blade 22 passing through the most distal end side in the radial direction is about 20 mm to 2000 mm.

The rotor blade 18 having the blade 22 is rotated by the motor 14 to generate an air flow (wind) in the rotation axis direction. A flow direction of the air flow is not limited, and may flow, in the rotation axis direction, from the motor 14 side to a direction opposite to the motor 14, or may flow from a side opposite to the motor 14 to the motor 14 side.

In addition, the casing 16 fixes the motor 14, and surrounds the rotor blade 18 (blade 22) that can be rotated in the radial direction.

The thickness of the casing 16 in the rotation axis direction is thicker than the thicknesses of the blade 22 and the shaft portion 20 such that the rotor blade 18 can be protected from the outside.

The casing 16 includes a support portion 16*a* that supports the motor 14 on one surface side in the rotation axis direction, an outer frame portion 16*b* that surrounds the rotor blade 18 from the outside in the radial direction, a cover portion 16*c* that covers a region of the shaft portion 20 on the other surface side in the rotation axis direction, and a fixed blade 16*d* that protrudes from the support portion 16*a* and/or the cover portion 16*c* toward the outside in the radial direction, and connects the support portion 16*a* and/or the cover portion 16*c*, and the outer frame portion 16*b*. The fixed blade 16*d* has a known blade shape, and has a function of rectifying the air flow generated by the rotation of the rotor blade 18.

The outer frame portion 16*b* has a cubic shape having an inner space 17 that penetrates in one direction. The support portion 16*a* is disposed on one opening surface side of the inner space 17 in the surface of the outer frame portion 16*b*, and the cover portion 16*c* is disposed on the other opening surface side. The opening portion of the inner space 17 in the surface of the outer frame portion 16*b* corresponds to an inner space of the axial fan according to the embodiment of the present invention. In the following description, the opening portion of the inner space 17 in the surface of the outer frame portion 16*b* is also referred to as an inner space 17.

A diameter of the support portion 16*a* need only be a size that can support the motor 14 and does not inhibit a flow of the air flow generated by the rotation of the rotor blade 18. For example, the diameter of the support portion 16*a* is substantially the same as the diameter of the shaft portion 20.

Similarly, a diameter of the cover portion 16*c* need only be a size that can protect the shaft portion 20 from the outside and does not inhibit a flow of the air flow generated by the rotation of the rotor blade 18. For example, the diameter of the cover portion 16*c* is substantially the same as the diameter of the shaft portion 20.

A width, the number, and the like of the fixed blade 16*d* need only be a size, the number, and the like that can reliably fix the support portion 16*a* and the outer frame portion 16*b*, and the cover portion 16*c* and the outer frame portion 16*b*, respectively, and does not inhibit a flow of the air flow generated by the rotation of the rotor blade 18.

The thickness of the casing 16 in the rotation axis direction need only be a thickness that can protect the rotor blade 18 from the outside, suppress the air flow in the radial direction among the air flows generated by the rotation of the rotor blade 18, and increase the air volume in the rotation axis direction, that is, need only be a thickness about 1.01 times to 3.00 times the thickness of the blade 22 and/or the shaft portion 20.

Note that, in the shown example, the configuration has been adopted in which the casing 16 has the support portion 16*a* that supports the motor 14 and the cover portion 16*c* that covers the region of the shaft portion 20, but a configuration may be adopted in which the casing 16 has only the support portion 16*a* that supports the motor 14 and does not have the cover portion 16*c* that covers the region of the shaft portion 20.

In addition, in the casing 16, at least one of the member connecting the support portion 16*a* and the outer frame portion 16*b* or the member connecting the cover portion 16*c* and the outer frame portion 16*b* need only be the fixed blade 16*d*, and the other may be the connecting portion that simply connects the members to each other. Note that, in a case in which the air flow generated by the rotation of the rotor blade 18 flows to the support portion 16*a* side, the member that connects the support portion 16*a* and the outer frame portion 16*b* need only be the fixed blade 16*d*, and in a case in which the air flow generated by the rotation of the rotor blade 18 flows to the cover portion 16*c* side, the member that connects the cover portion 16*c* and the outer frame portion 16*b* need only be the fixed blade 16*d*. Alternatively, the casing 16 may have a configuration in which the fixed blade 16*d* is not provided. That is, the member that connects the support portion 16*a* and the outer frame portion 16*b* and the member that connects the cover portion 16*c* and the outer frame portion 16*b* may not have a blade shape, and the function of rectifying the air flow generated by the rotation of the rotor blade 18 is not provided.

Further, the axial fan 12 may have various configurations of a known axial fan. For example, in the examples shown in FIGS. 1 to 3, the axial fan 12 has a hole 16*e* into which a fastening member such as a screw is inserted in a case in which the axial fan 12 is fixed to various devices.

The silencer 30 is disposed at a position connected to the inner space 17 of the axial fan 12. Here, the fact that the silencer 30 is connected to the inner space 17 means that, in the silencer 30, a portion for allowing the sound waves to enter the silencer 30 in order to exert a silencing function communicates with the inner space 17. For example, in a Helmholtz resonator and an air column resonator, the opening portion corresponds to a portion for allowing the sound waves to enter. In addition, in the film type resonator, the surface of the film corresponds to a portion for allowing the sound waves to enter. In addition, in the porous sound absorbing material, the surface thereof corresponds to a portion for allowing sound waves to enter.

In the example shown in FIG. 3, the silencer 30 is a Helmholtz resonator 30*a*, and four Helmholtz resonators 30*a* are disposed on an outer circumferential surface of the outer frame portion 16*b* of the casing 16.

As is well known, in the Helmholtz resonator 30*a*, an opening portion 34 that communicates an inner space 36 to the outside is formed in a case 32 having the inner space 36. The Helmholtz resonator 30*a* has a structure in which the air in the inner space 36 acts as a spring, the air in the opening portion 34 acts as a mass (mass), the mass spring resonates, and a portion in the vicinity of the wall of the opening portion 34 absorbs the sound by thermal viscous friction.

Note that, in the following description, in a case in which it is not necessary to distinguish the types of silencers, such as the Helmholtz resonator 30*a*, an air column resonator 30*b*, and a film type resonator 30*c* described below, the silencers are collectively referred to as the silencer 30.

As shown in FIG. 3, the Helmholtz resonator 30*a* is disposed with the opening portion 34 facing the inner space 17 side of the casing 16. A through-hole 15 that penetrates from the outer circumferential surface to an inner circumferential surface of the outer frame portion 16*b* is formed at a position of the outer frame portion 16*b* of the casing 16 corresponding to the opening portion 34 of the Helmholtz resonator 30*a*. As a result, the opening portion 34 of the Helmholtz resonator 30*a* communicates with the inner space 17 of the casing 16 via the through-hole 15. Therefore, the Helmholtz resonator 30*a* is connected to the inner space 17.

Here, the blower 10 with the silencer according to the embodiment of the present invention has a configuration in which the axial fan 12 has a sound pressure distribution having a position at which the sound pressure is high and a position at which the sound pressure is low in the circumferential direction in the inner space 17, and the silencer 30 is connected to the position of the axial fan 12 in the circumferential direction at which the sound pressure is high and is not connected to the position at which the sound pressure is low.

As described above, according to the examination by the present inventors, it has been found that, in a case in which the resonator is disposed inside the axial fan, the sound may be amplified and may not be appropriately silenced depending on the disposition position. Specifically, it is found that, in a case in which the sound pressure distribution occurs in the circumferential direction inside the axial fan, and the resonator is connected to the position at which the sound pressure is low, the sound may be amplified in addition to simply reducing the silencing effect.

It is generally known that, in a case in which the axial fan is disposed in a duct, a mode is formed in the axial direction, that is, the sound pressure distribution occurs. However, it has not been known that a mode is formed in the circumferential direction of the axial fan, that is, the sound pressure distribution occurs. Therefore, in the related art, how to dispose the resonator in the circumferential direction of the axial fan has not been considered.

On the other hand, the present inventors has found that the sound pressure distribution occurs in the circumferential direction in the inner space of the axial fan. Since the blower with the silencer according to the embodiment of the present invention has a configuration in which the silencer is connected to the position at which the sound pressure is high with respect to the sound pressure distribution in the circumferential direction of the axial fan, the silencing effect of the silencer can be enhanced, and since the blower with the silencer has a configuration in which the silencer is not connected to the position at which the sound pressure is low, the amplification of the sound can be prevented.

Here, the cause of the sound pressure distribution in the circumferential direction in the inner space of the axial fan is presumed that, in the axial fan 12, the casing 16 has the support portion 16*a* in order to dispose the rotor blade 18 and the motor 14 at the center in the radial direction, and has the fixed blade 16*d* (or a connecting portion that does not have a function of blade) in order to connect the support portion 16*a* with the outer frame portion 16*b*. Each of blades 22 is an aerodynamic sound source, and the sound is radiated by the pressure fluctuation on the surface thereof. The radiated sound hits the fixed blade 16*d* present in the immediate vicinity (distance sufficiently smaller than the wavelength of the sound) and is restricted. That is, since a plurality of sound sources that are moved with rotation are present and the fixed blade 16*d* is provided in the immediate vicinity thereof, complicated acoustic interference occurs, the propagation of sound waves is biased in the circumferential direction, and the sound pressure distribution in the circumferential direction occurs.

From the point that the bias of the sound pressure distribution in the circumferential direction is larger, the invention of the present application is more suitably applied in a case in which the axial fan 12 has the fixed blade 16*d*. Similarly, the fixed blade 16*d* is more suitably applied in a case in which the rotor blade 18 is disposed on the downstream side of the air flow generated by the rotation.

In addition, in a case in which the axial fan 12 has the fixed blade 16*d* and the number of blades of the rotor blade 18 is equal to or more than the number of blades of the fixed blade 16*d*, the bias of the sound pressure distribution in the circumferential direction is further increased, so that the invention of the present application is more suitably applied.

In a case in which the number of blades of the rotor blade 18 is equal to or more than the number of blades of the fixed blade 16*d*, as viewed from the axial direction, in the space (hereinafter, also referred to as fixed blade opening portion) between the blades of the adjacent fixed blades 16*d*, a timing at which a plurality of blades of the rotor blade 18 are present occurs. Since each of the blades of the rotor blade 18 can be regarded as the sound source, two sound sources are present in one fixed blade opening portion as viewed from the axial direction. In that case, it is considered that the sound waves generated from the respective sound sources interact with each other in the fixed blade opening portion due to interference or the like, so that the bias of the sound pressure distribution in the circumferential direction in one fixed blade opening portion is further increased.

Figure 4:
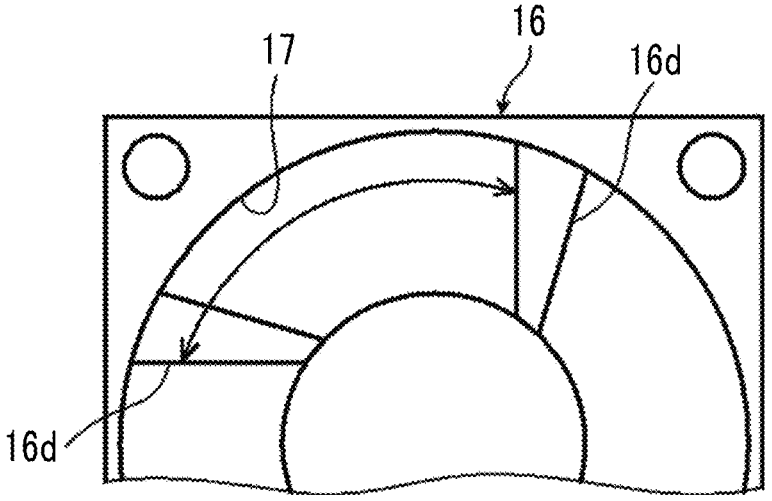
FIG. 4 is a partially enlarged view of FIG. 2.
Figure 5:
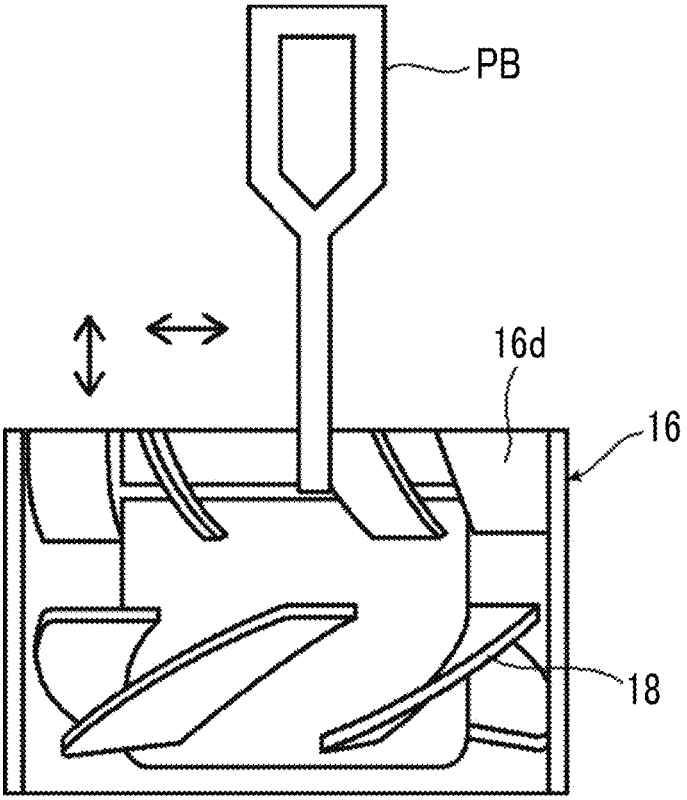
FIG. 5 is a diagram conceptually showing an example of a measuring method of a sound pressure distribution.

The sound pressure distribution in the inner space of the axial fan in the circumferential direction (hereinafter, also referred to as the sound pressure distribution of the axial fan in the circumferential direction) can be measured by, for example, performing scanning with a probe microphone PB, which measures the sound pressure, in the fixed blade opening portion in the circumferential direction (right-left direction in FIG. 5) and the axial direction (up-down direction in FIG. 5) as shown in FIG. 5 in a state of operating the axial fan in the space (fixed blade opening portion) between the blades of the adjacent fixed blades 16*d* as shown in FIG. 4.

Figure 6:
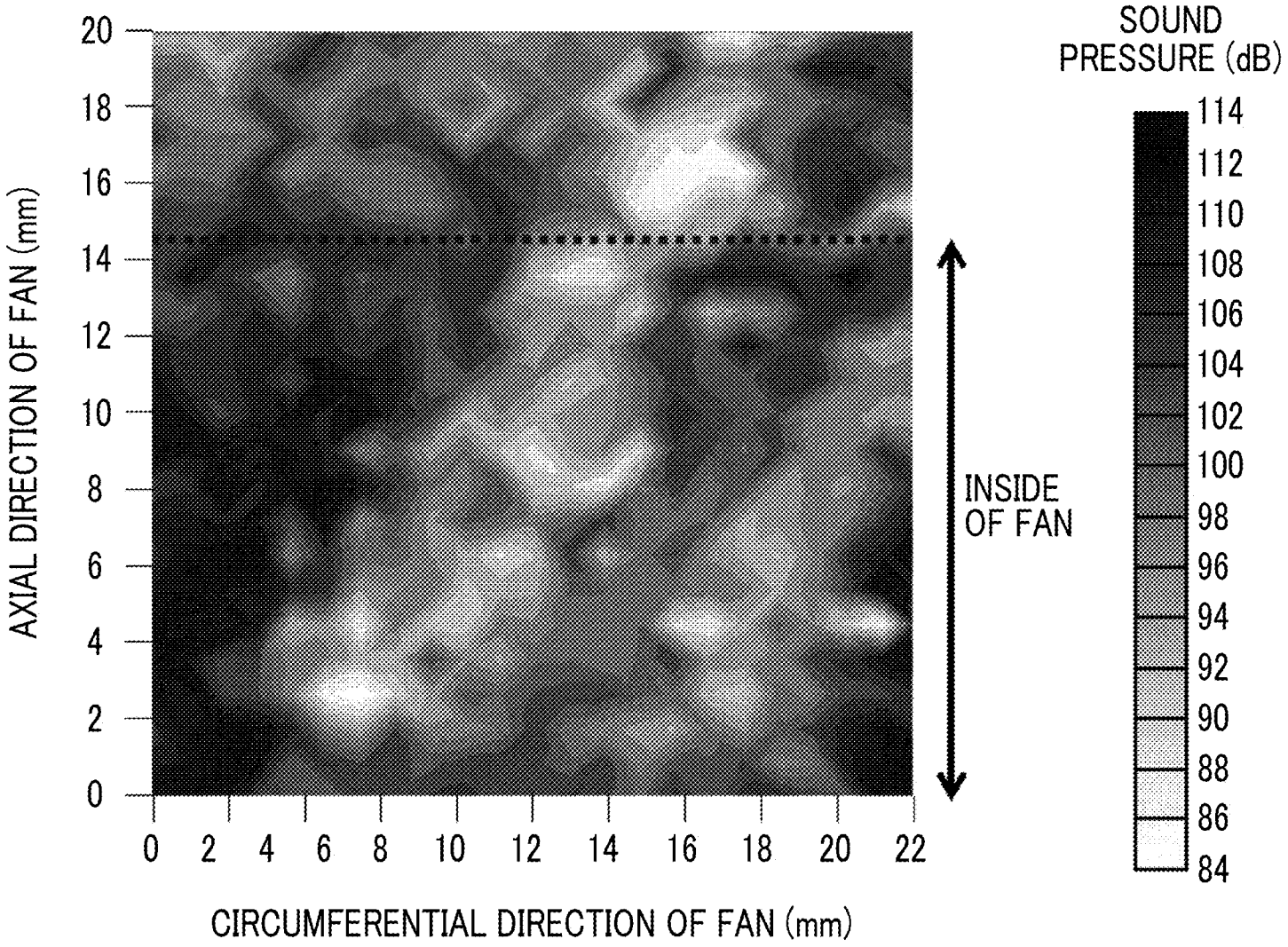
FIG. 6 is a graph showing an example of measurement results of the sound pressure distribution.

An example of measuring the sound pressure distribution of the axial fan in the circumferential direction as described above is shown in FIG. 6. FIG. 6 is a diagram showing the sound pressure distribution in the circumferential direction of the axial fan used in examples described below. As shown in FIG. 6, it was found that the sound pressure distribution having the position at which the sound pressure was high and the position at which the sound pressure was low occurred in the axial fan in the circumferential direction.

The probe microphone PB has a thin tubular probe attached to a distal end of the microphone. For example, the probe is a member having a hole diameter of 1.5 mm, an outer diameter of 2.5 mm, and a sleeve length of 50 mm. This probe microphone PB is inserted into the inner space of the axial fan and measures the sound pressure. By using a thin probe, it is possible to reduce the influence on the wind and it is possible to measure the sound pressure at a local position.

Here, having the sound pressure distribution in the circumferential direction of the axial fan means a case in which the difference between the maximum value and the minimum value of the sound pressure in the circumferential direction sound pressure distribution is 6 dB or more. The sound pressure need only be obtained from the average value by performing measurement 5 times or more, and the difference between the maximum value and the minimum value.

In addition, in a case in which the maximum value of the sound pressure in the sound pressure distribution in the circumferential direction is denoted by $P_{max}$ and the minimum value is denoted by $P_{min}$, the position of the axial fan in the circumferential direction at which the sound pressure is high is a position having the sound pressure equal to or more than $P_{max}-0.4\times(P_{max}-P_{min})$. In addition, the position at which the sound pressure is low is a position having the sound pressure equal to or less than $P_{min}+0.4\times(P_{max}-P_{min})$.

From the viewpoint of enhancing the silencing effect, in the sound pressure distribution in the circumferential direction, the silencer is preferably connected to a position having the sound pressure equal to or more than $P_{max}+0.3\times(P_{max}-P_{min})$, is more preferably connected to a position having the sound pressure equal to or more than $P_{max}+0.2\times(P_{max}-P_{min})$, and is still more preferably connected to a position having the sound pressure equal to or more than $P_{max}+0.1\times(P_{max}-P_{min})$.

In addition, from the viewpoint that the silencing effect can be further enhanced, it is preferable that the silencer be disposed at a position at which the fixed blade 16*d* (or the connecting portion) is present in the axial direction.

In addition, as shown in FIG. 1, the blower with the silencer according to the embodiment of the present invention may include a plurality of silencers. Each silencer 30 need only be connected to the position of the axial fan 12 in the circumferential direction at which the sound pressure is high. In addition, in a case in which the axial fan 12 has a plurality of fixed blades 16*d*, it is preferable that the silencers be connected to at least two fixed blade opening portions between the adjacent fixed blades 16*d*, and it is more preferable that the silencers be connected to all the fixed blade opening portions.

In a case in which the axial fan 12 has the fixed blade 16*d*, the sound pressure in the circumferential direction tends to be high in the vicinity of the fixed blade 16*d*. Therefore, it is preferable that the silencer 30 be disposed in the vicinity of the fixed blade 16*d* in the circumferential direction. Specifically, it is preferable that the silencer 30 be disposed at a position within 25% of the distance between the adjacent fixed blades 16*d*, from the fixed blade 16*d*.

Here, in the example shown in FIGS. 1 to 3, the configuration has been adopted in which the silencer 30 is disposed outside the casing 16 and is connected to the inner space 17 of the axial fan 12 via the through-hole 15 formed in the outer frame portion 16*b* of the casing 16, but the present invention is not limited to this.

Figure 7:
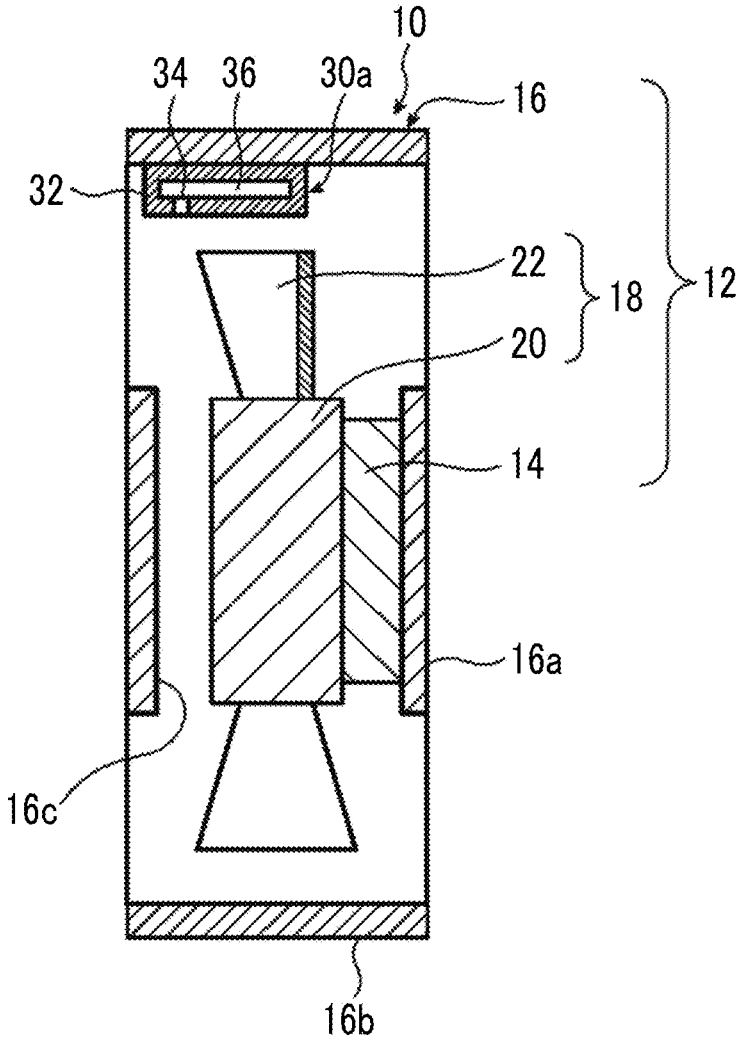
FIG. 7 is a cross-sectional view schematically showing still another example of the blower with the silencer according to the embodiment of the present invention.

For example, as shown in FIG. 7, the silencer 30 (Helmholtz resonator 30*a*) may be disposed in the inner space 17 of the axial fan 12. In the example shown in FIG. 7, in the Helmholtz resonator 30*a* disposed in the inner space 17, the opening portion 34 is connected to the position of the axial fan 12 in the circumferential direction at which the sound pressure is high.

Note that, from the viewpoint of air permeability, it is preferable that the silencer 30 be disposed at a position that does not overlap with the region formed by the rotation of the rotor blade 18 as viewed from the axial direction of the axial fan 12.

In addition, in the examples shown in FIGS. 2 and 3, the configuration has been adopted in which the Helmholtz resonator 30*a* is used as the silencer, but the present invention is not limited to this.

Figure 8:
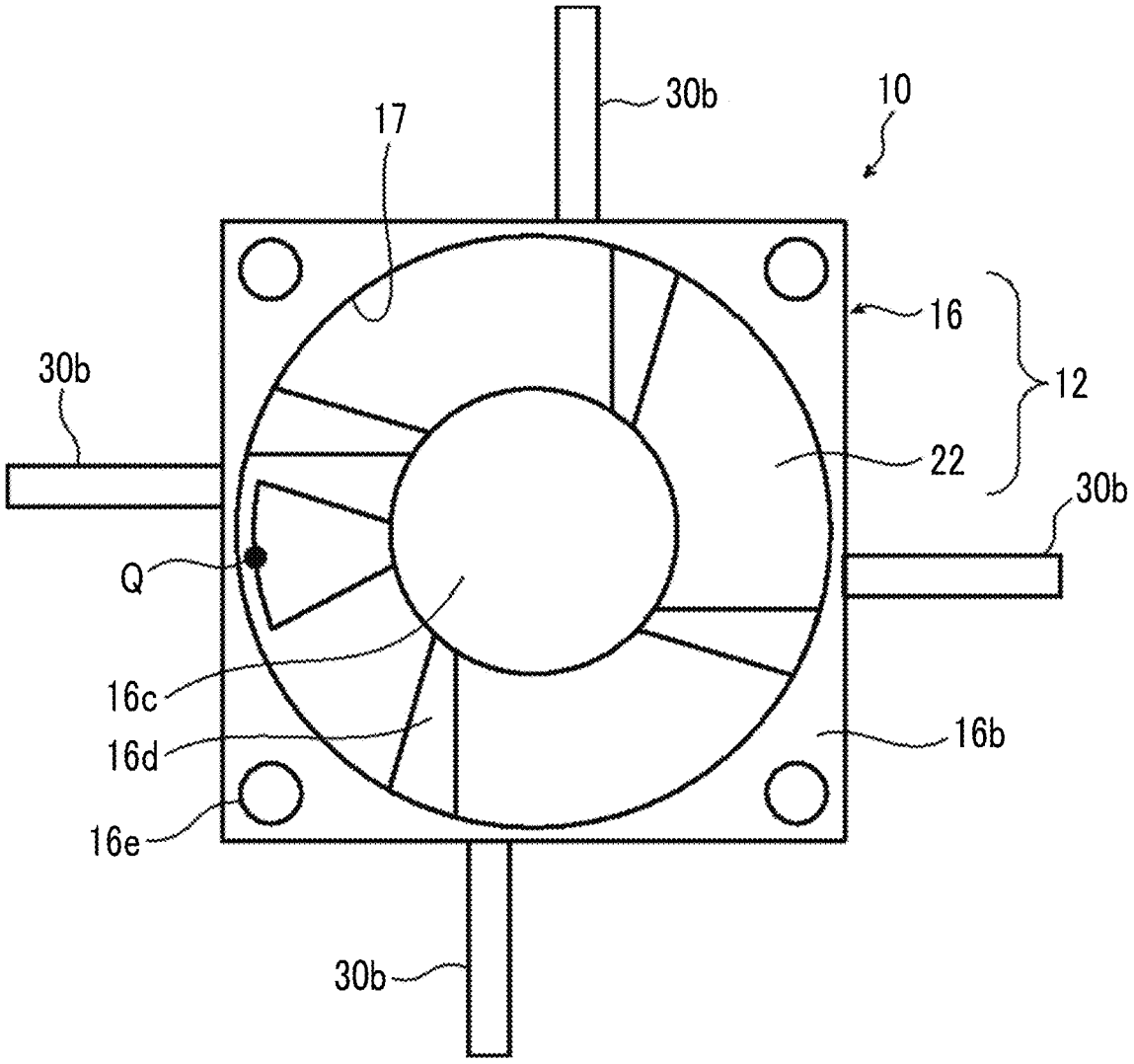
FIG. 8 is a cross-sectional view schematically showing still another example of the blower with the silencer according to the embodiment of the present invention.

For example, as in the example shown in FIG. 8, a configuration may be adopted in which the air column resonator 30*b* is used as the silencer. As is well known, in the air column resonator, the resonance occurs by generating a standing wave in a resonance pipe having an opening. In the blower 10 with the silencer shown in FIG. 8, the air column resonator 30*b* is disposed on each of four outer circumferential surfaces of the outer frame portion 16*b* of the casing 16 of the axial fan 12. Each of the four air column resonators 30*b* has an opening connected to a fixed blade opening portion (inner space 17) (not shown).

Note that, in the example shown in FIG. 8, the configuration has been adopted in which the air column resonator 30*b* includes a resonance pipe extending to the outer side from the axial fan 12 in the radial direction, but is not limited to this. The air column resonator 30*b* may have a configuration in which the resonance pipe extends in the axial direction or a configuration in which the resonance pipe extends in the circumferential direction as long as the opening is connected to the inner space 17. In addition, the air column resonator 30*b* may be a resonance pipe of which a pipe line is bent in the middle.

Figure 9:
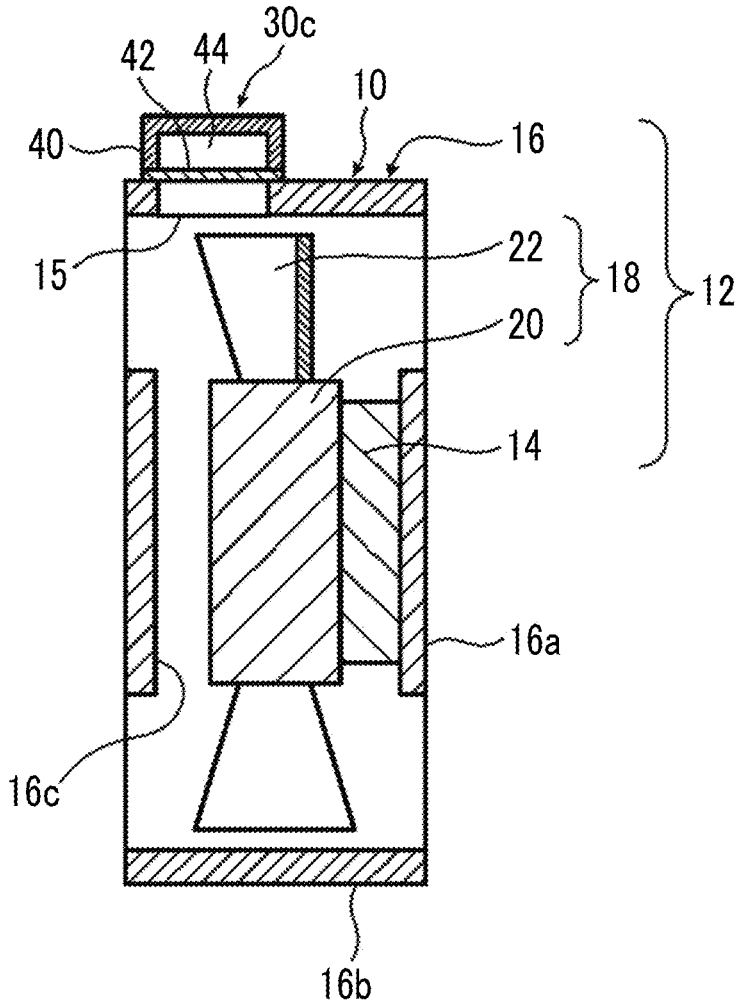
FIG. 9 is a cross-sectional view schematically showing still another example of the blower with the silencer according to the embodiment of the present invention.

In addition, as in the example shown in FIG. 9, a configuration may be adopted in which the film type resonator 30*c* is used as the silencer. The film type resonator 30*c* has a frame 40 and a film 42, and resonates due to the film vibration of the film 42 supported by the frame 40 to allow vibration. In the blower 10 with the silencer shown in FIG. 9, the film type resonator 30*c* is disposed on the outer circumferential surface of the outer frame portion 16*b* of the casing 16 of the axial fan 12. The film type resonator 30*c* has the film 42 disposed toward the casing 16 and is connected to the fixed blade opening portion (inner space 17) via a penetration portion formed in the casing 16.

The frame 40 has a shape in which a rectangular parallelepiped shaped opening portion with a bottom surface formed on one surface is formed. That is, the frame 40 is a bottomed box shape with one surface open.

The film 42 is a film-like member, and covers an opening surface of the frame 40 on which the opening portion is formed, and a peripheral portion thereof is fixed to the frame 40 and is supported to allow vibration thereof.

In addition, a back space 44 surrounded by the frame 40 and the film 42 is formed on a back side (frame 40 side) of the film 42. In the example shown in FIG. 9, the back space is a closed space, which is closed.

In addition, in the examples described above, the configuration has been adopted in which the resonator is used as the silencer, but the present invention is not limited to this. As the silencer, various known silencers, such as the porous sound absorbing material, can be used.

The porous sound absorbing material is not particularly limited, and a known porous sound absorbing material can be appropriately used. For example, various known porous sound absorbing material can be used, such as foam materials and materials containing minute air such as urethane foam, soft urethane foam, wood, ceramic particle sintered material, and phenol foam; fibers and nonwoven fabric materials such as glass wool, rock wool, microfibers (Thinsulate manufactured by 3M), a floor mat, a carpet, a melt-blown nonwoven fabric, a metal nonwoven fabric, a polyester nonwoven fabric, metal wool, felt, an insulation board and a glass nonwoven fabric, and wood wool cement board, nanofiber materials such as silica nanofiber, and gypsum board.

A flow resistance of the porous sound absorbing material is not particularly limited, but is preferably 1000 to 100000

($Pa \cdot s/m^2$), more preferably 3000 to 80000 ($Pa \cdot s/m^2$), and still more preferably 5000 to 50000 ($Pa \cdot s/m^2$).

The flow resistance of the porous sound absorbing material can be evaluated by measuring a perpendicular incident sound absorbance of the porous sound absorbing material having a thickness of 1 cm and fitting by the Miki model (J. Acoust. Soc. Jpn., 11(1), pp. 19 to 24 (1990)). Alternatively, an evaluation may be made according to "ISO 9053".

In addition, a plurality of porous sound absorbing materials having different flow resistances may be laminated.

In addition, the blower with the silencer according to the embodiment of the present invention may include different types of silencers.

Here, the axial fan 12 rotates the rotor blade having the plurality of blades to impart the kinetic energy to the gas and blow the gas in the axial direction. Therefore, the axial fan 12 generates a sound of which a sound pressure is a maximum value at a specific frequency which is determined by the rotation speed and the number of blades. In the following description, the sound of the axial fan 12 of which the sound pressure is a maximum value at a specific frequency which is determined by the rotation speed and the number of blades is referred to as a discrete frequency sound.

Specifically, the discrete frequency sound is a sound having a tone-to-noise ratio (TNR) defined by the European standard ECMA-74 as a prominent discrete tone or a prominence ratio (PR) of 3 dB or more.

As described above, since the axial fan 12 generates the sound of which the sound pressure is the maximum value at a specific frequency, it is preferable to use the resonator as the silencer from the viewpoint of selectively silencing the discrete frequency sound. That is, the resonator need only be disposed at the position at which the sound pressure is high in the sound pressure distribution in the circumferential direction at the frequency of at least one discrete frequency sound caused by the rotor blade 18 of the axial fan 12. In addition, it is preferable that the resonator be disposed at each of two or more positions at which the sound pressure is high with respect to the sound pressure distribution in the circumferential direction of at least one discrete frequency sound.

The resonator sets the resonance frequency to be substantially the same as the frequency of the discrete frequency sound, thereby using the resonance phenomenon to silence the sound (discrete frequency sound) at that frequency. Specifically, in a case in which the resonance frequency of the resonator is denoted by $f_0$ and at least one frequency of the discrete frequency sound caused by the rotor blade 18 of the axial fan 12 is denoted by $f_n$, the resonance frequency $f_0$ of the resonator is preferably in a range of $0.8 \times f_n$ to $1.1 \times f_n$, more preferably in a range of $0.85 \times f_n$ to $1.05 \times f_n$, still more preferably in a range of $0.90 \times f_n$ to $0.99 \times f_n$, and most preferably in a range of $0.90 \times f_n$ to $0.95 \times f_n$. By setting the resonance frequency $f_0$ of the resonator to a slightly lower frequency side than the frequency of the discrete frequency sound, the silencing efficiency is enhanced. In addition, depending on the wind speed, in a case in which the resonance frequency $f_0$ and the discrete frequency sound $f_n$ match, the amplification of the wind noise by the resonator is a problem, so it is desirable that the resonance frequency $f_0$ slightly deviate from $f_n$ from that point as well.

For example, the resonance frequency of Helmholtz resonator 30*a* is determined by a volume of the inner space 36 surrounded by the case 32, an area and a length of the opening portion 34, and the like. Therefore, the frequency of the resonating sound can be appropriately set by adjusting the volume of the inner space of the case 32 of the Helmholtz resonator 30*a*, the area and the length of the opening portion 34, and the like.

In addition, the resonance frequency of the air column resonator 30*b* is determined by a length of the resonance pipe and the like. Therefore, the frequency of the resonating sound can be appropriately set by adjusting the depth of the resonance pipe, the size of the opening, and the like.

In addition, the resonance frequency of the film type resonator 30*c* is determined by the size (size of the vibration surface, that is, a size of the opening portion of the frame 40), the thickness, the hardness, and the like of the film 42. Therefore, the frequency of the resonating sound can be appropriately set by adjusting the size, the thickness, the hardness, and the like of the film 42.

Note that in a case in which a configuration is adopted in which the resonator has the inner space and the through-hole (opening portion) which communicates the inner space to the outside, whether a resonance structure causing air column resonance or a resonance structure causing Helmholtz resonance is provided is determined in response to the size and position of the through-hole, the size of the inner space, and the like. Therefore, by adjusting the above appropriately, it is possible to select whether the air column resonance or the Helmholtz resonance is adopted as the resonance structure.

In the case of air column resonance, in a case in which the opening portion is narrow, the sound waves are reflected at the opening portion and it is difficult for the sound waves to enter the inner space, and thus it is preferable that the opening portion be wide to a certain extent. Specifically, in a case in which the opening portion has a rectangular shape, the length of the short side is preferably 1 mm or more, more preferably 3 mm or more, and still more preferably 5 mm or more. In a case in which the opening portion has a circular shape, it is preferable that the diameter be in the range described above.

On the other hand, in the case of Helmholtz resonance, it is necessary to generate thermal viscous friction at the through-hole, and thus it is preferable that the opening portion be narrow to a certain extent. Specifically, in a case in which the through-hole has a rectangular shape, the length of the short side is preferably 0.5 mm or more and 20 mm or less, more preferably 1 mm or more and 15 mm or less, and still more preferably 2 mm or more and 10 mm or less. In a case in which the through-hole has a circular shape, it is preferable that the diameter be in the range described above.

In addition, in a case in which the axial fan 12 generates a plurality of discrete frequency sounds, the silencer 30 need only silence at least one discrete frequency sound, but a configuration may be adopted in which a plurality of resonators having substantially the same resonance frequencies with respect to the plurality of discrete frequency sounds are provided. For example, a configuration may be adopted in which, in a case in which one frequency of the discrete frequency sound caused by the rotor blade 18 of the axial fan 12 is denoted by $f_{n1}$ and the frequency of the other discrete frequency sound is denoted by $f_{n2}$, a resonator having the resonance frequency in a range of and $0.8 \times f_{n1}$ to $1.1 \times f_{n1}$ and a resonator having the resonance frequency in a range of $0.8 \times f_{n2}$ to $1.1 \times f_{n2}$ are provided.

Note that, it is preferable to use the resonator having the flow passage communicating with the inner space 17 of the axial fan 12 as the resonator. That is, it is preferable to use the Helmholtz resonator 30*a* or the air column resonator 30*b* as the resonator. As described above, the resonance frequency of the film type resonator 30*c* depends on the size of the film 42 (vibration surface). Specifically, it is necessary to increase the size of the film 42 (vibration surface) in order to adjust the resonance frequency of the film type resonator 30*c* to a low frequency. However, the adjustment of the resonance frequency is difficult in a range of the size that can be disposed on (connected to) the axial fan 12. On the other hand, in a case of the Helmholtz resonator 30*a* and the air column resonator 30*b*, the flow passage (opening portion) that communicates with the inner space 17 need only be provided, and the resonance frequency can be adjusted without increasing the opening portion itself. Therefore, for example, even in a case in which the resonance frequency is adjusted to a low frequency, the connection to the inner space 17 of the axial fan 12 can be easily performed.

Examples of materials of the frame and the case of the film type resonator, the Helmholtz resonator, and the air column resonator (hereinafter, collectively referred to as a "frame material") include a metal material, a resin material, a reinforced plastic material, a carbon fiber, and the like. Examples of the metal material include metal materials, such as aluminum, titanium, magnesium, tungsten, iron, steel, chromium, chromium molybdenum, nichrome molybdenum, copper, and alloys thereof. In addition, examples of the resin material include resin materials, such as an acrylic resin, polymethyl methacrylate, polycarbonate, polyamide-imide, polyarylate, polyetherimide, polyacetal, polyether ether ketone, polyphenylene sulfide, polysulfone, polyethylene terephthalate, polybutylene terephthalate, polyimide, an acrylonitrile, butadiene, styrene copolymer synthetic resin (ABS resin), polypropylene, and triacetyl cellulose. In addition, examples of the reinforced plastic material include carbon fiber reinforced plastics (CFRP), and glass fiber reinforced plastics (GFRP). In addition, natural rubber, chloroprene rubber, butyl rubber, ethylene/propylene/diene rubber (EPDM), silicone rubber, and the like, and rubber containing these crosslinked structures are exemplary examples.

In addition, as the frame material, various honeycomb core materials can be used. Since the honeycomb core material is lightweight and used as a highly rigid material, ready-made product thereof is easily available. As the frame, it is possible to use the honeycomb core material made of various materials such as aluminum honeycomb core, FRP honeycomb core, paper honeycomb core (manufactured by Shin Nippon Feather Core Co., Ltd., manufactured by Showa Aircraft Industry Co., Ltd., and the like), a thermoplastic resin (PP, PET, PE, PC, and the like) honeycomb core (TECCELL manufactured by Gifu Plastic Industry Co., Ltd., and the like).

In addition, a structure containing air, that is, a foam material, a hollow material, a porous material, or the like can also be used as the frame material. In order to prevent the ventilation between cells in a case in which a large number of resonators are used, for example, a closed cell foam material and the like can be used to form the frame. For example, various materials such as closed cell polyurethane, closed cell polystyrene, closed cell polypropylene, closed cell polyethylene, and a closed cell rubber sponge can be selected. By using closed cell material, sound, water, gas, or the like is not allowed to pass through, and the structural strength is high as compared with an open cell material, and thus it is suitable for being used as the frame material. In addition, in a case in which the porous sound absorbing body described above has sufficient supportability, the frame may be formed only by the porous sound absorbing body, and examples of the porous sound absorbing body and the material of the frame are used in combination by for example, mixing or kneading. As described above, the weight of the device can be reduced by using the material system including air inside. In addition, a heat insulating property can be imparted.

Here, from the viewpoint of disposition at a high temperature position, it is preferable that the frame material be made of a material having higher heat resistance than the flame retardant material. The heat resistance can be defined, for example, by the time that satisfies each item of Article 108-2 of the Building Standards Law Enforcement Ordinance. In a case in which the time that satisfies each item of Article 108-2 of the Building Standards Law Enforcement Ordinance is 5 minutes or more and less than 10 minutes, it is a flame retardant material, in a case in which the time is 10 minutes or more and less than 20 minutes, it is a semi-incombustible material, and in a case in which the time is 20 minute or more, it is a non-combustible material. Note that, in many cases, the heat resistance is defined for each field. Therefore, the frame material need only be made of a material having the heat resistance equivalent to or higher than the flame retardance defined in the field in response to the field in which the blower with the silencer is used.

The wall thicknesses of the frame and the case (frame thickness) are not particularly limited, and can be set in response to, for example, the size of the opening cross section of the frame.

Examples of the film 42 include various metals such as aluminum, titanium, nickel, permalloy, 42 alloy, kovar, nichrome, copper, beryllium, phosphor bronze, brass, nickel silver, tin, zinc, iron, tantalum, niobium, molybdenum, zirconium, gold, silver, platinum, palladium, steel, tungsten, lead, and iridium; and the resin materials such as polyethylene terephthalate (PET), triacetyl cellulose (TAC), polyvinylidene chloride (PVDC), polyethylene (PE), polyvinyl chloride (PVC), polymethylpentene (PMP), cycloolefin polymer (COP), zeonoa, polycarbonate, polyethylene naphthalate (PEN), polypropylene (PP), polystyrene (PS), polyarylate (PAR), aramid, polyphenylene sulfide (PPS), polyether sulfone (PES), nylon, polyester, cyclic olefin copolymer (COC), diacetyl cellulose, nitro cellulose, cellulose derivative, polyamide, polyamide-imide, polyoxymethylene (POM), polyetherimide (PEI), polyrotaxane (slide ring material or the like), and polyimide. Further, a glass material such as thin film glass and a fiber reinforced plastic material, such as carbon fiber reinforced plastics (CFRP) and glass fiber reinforced plastics (GFRP), can also be used. In addition, natural rubber, chloroprene rubber, butyl rubber, EPDM, and silicone rubber, and rubber having these crosslinked structures can be used. Alternatively, a combination thereof may be used.

In addition, in a case in which the metal material is used, the surface may be metal-plated from the viewpoint of suppressing rust.

From the viewpoint of excellent durability against heat, ultraviolet rays, external vibration, or the like, it is preferable to use the metal material as the material of the film 42 in applications requiring durability.

In addition, a fixing method of the film to the frame is not particularly limited, and a method of using a double-sided tape or an adhesive, a mechanical fixing method such as screwing, crimping or the like can be appropriately used. The fixing method can also be selected from the viewpoints of heat resistance, durability, and water resistance as in the case of the frame material and the film. For example, as the adhesive, "Super X" series manufactured by CEMEDINE Co., Ltd., "3700 series (heat resistant)" manufactured by ThreeBond Holdings Co., Ltd., heat resistant epoxy adhesive "Duralco series" manufactured by TAIYO WIRE CLOTH CO., LTD., and the like can be selected. In addition, as the double-sided tape, Ultra High Temperature Double Coated Tape 9077 manufactured by 3M or the like can be selected. As described above, various fixing methods can be selected for the required characteristic.

The thickness of the film 42 is preferably less than 100 μm, more preferably 70 μm or less, and still more preferably 50 μm or less. Note that in a case in which the thickness of the film 42 is not uniform, an average value thereof need only be in the range described above. On the other hand, in a case in which the thickness of the film is too thin, it is difficult to be treated. A film thickness is preferably 1 μm or more, and more preferably 5 μm or more.

A Young's modulus of the film 42 is preferably 1000 Pa to 1000 GPa, more preferably 10000 Pa to 500 GPa, and most preferably 1 MPa to 300 GPa.

A density of the film 42 is preferably 10 $kg/m^3$ to 30000 $kg/m^3$, more preferably 100 $kg/m^3$ to 20000 $kg/m^3$, and most preferably 500 $kg/m^3$ to 10000 $kg/m^3$.

In addition, in the film type resonator, the thickness of the back space 44 is preferably 10 mm or less, more preferably 5 mm or less, and still more preferably 3 mm or less. Note that in a case in which the thickness of the back space is not uniform, an average value thereof need only be in the range described above.

Note that a method of attaching the silencer (resonator) to the casing of the axial fan is not particularly limited, and a known fixing method such as a method using an adhesive, a pressure sensitive adhesive, a double-sided tape, and a mechanical method such as screwing can be used as appropriate.

In addition, each resonator may have a configuration in which the porous sound absorbing material is further provided in the space of the resonator. For example, a configuration may be adopted in which the porous sound absorbing material is provided in the back space 44 of the film type resonator 30*c*. In addition, a configuration may be adopted in which the Helmholtz resonator 30*a* has the porous sound absorbing material in the inner space 36. By adopting a configuration in which the resonator includes the porous sound absorbing material, it is possible to silence the sound having a frequency other than the dominant sound selectively silenced by the resonator, in a wide band.

In addition, in the example shown in FIG. 9, the back space 44 of the film type resonator 30*c* is a closed space completely surrounded by the frame 40 and the film 42, but is not limited to this, and the space need only be substantially divided such that the air flow is inhibited, and an opening may be provided in a part of the film 42 or the frame 40 in addition to the completely closed space. Such a form providing the opening in a part thereof is preferable from the point that a change in the sound absorption characteristic as a gas in the back space is expanded or contracted due to a temperature change, tension is applied to the film 42, and the hardness of the film 42 is changed can be prevented.

By forming a through-hole in the film 42, propagation due to air propagation sound occurs. Due to the above, the acoustic impedance of the film 42 is changed. In addition, the mass of the film 42 is reduced due to the through-hole. Due to the above, the resonance frequency of the film type resonator 30*c* can be controlled. A position in which the through-hole is formed is not particularly limited.

EXAMPLES

The present invention will be described below in more detail with reference to examples. The materials, the usage amounts, the ratios, the processing contents, the processing procedures, and the like shown in the following examples can be appropriately changed without departing from the spirit of the present invention. Therefore, the scope of the present invention should not be construed as being limited by the following examples.

[Axial Fan]

San Ace 60 (Model: 9GA0624P1G03 manufactured by SANYO DENKI CO., LTD.) was prepared as the axial fan. This axial fan had the casing having the outer shape of 60 mm×60 mm and the thickness of 38 mm, in which the number of blades of the fixed blade was five and the number of blades of the rotor blade was seven. In a case in which a rated current was applied to this axial fan, a basic mode of a fan peak sound (discrete frequency sound) appeared in the vicinity of 1.8 kH.

[Sound Pressure Distribution in Circumferential Direction of Axial Fan]

The sound pressure distribution in the circumferential direction in the inner space of the axial fan was measured as follows.

Figure 10:
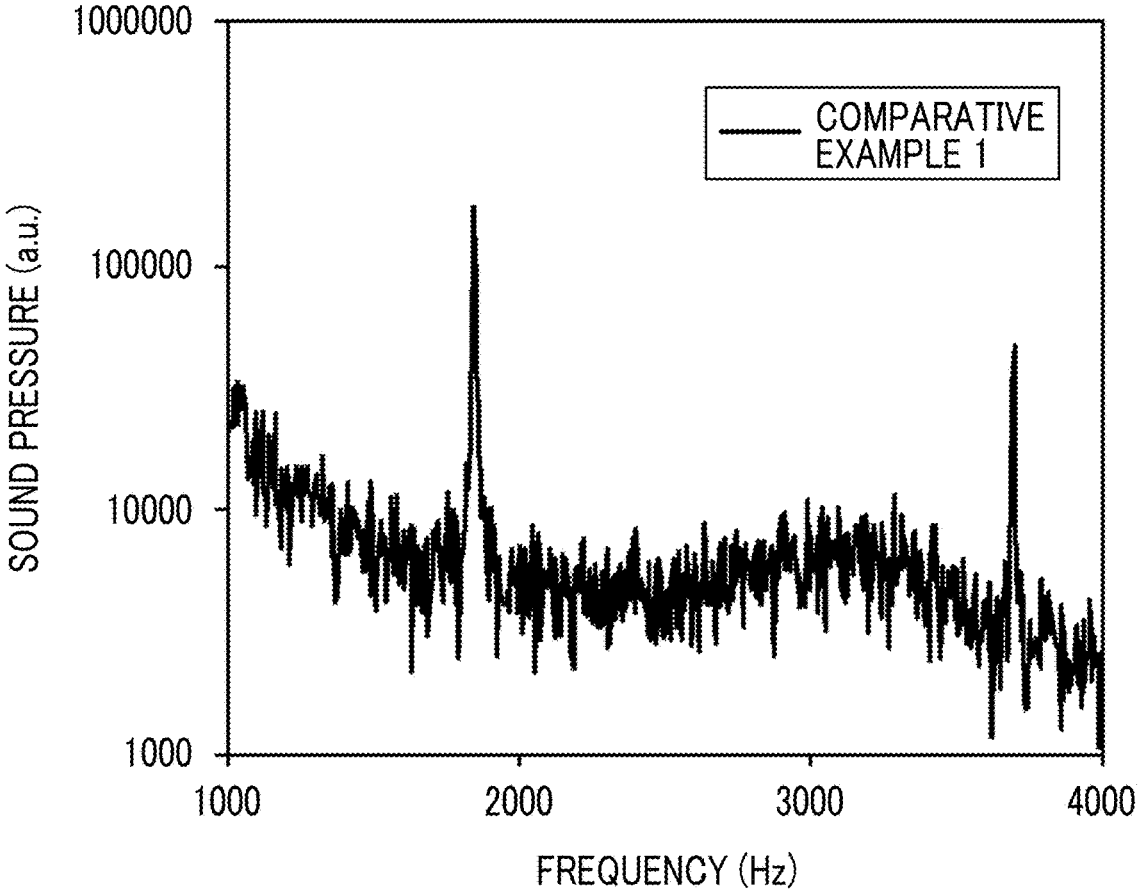
FIG. 10 is a graph showing a relationship between the frequency and the sound pressure.

A custom-made probe (the hole diameter was 1.5 mm, the outer diameter was 2.5 mm, and the sleeve length was 50 mm) was attached to the distal end of the microphone (4152N, manufactured by ACO Co., Ltd.) to manufacture the probe microphone PB. In a state of operating the axial fan, the manufactured probe microphone PB was inserted into the fixed blade opening portion of the axial fan as shown in FIG. 5, and scanning in the circumferential direction and the axial direction was performed to measure the sound pressure. The sound pressure at each measurement point was measured by setting an initial position in the circumferential direction to the vicinity of the fixed blade and an initial position in the axial direction to a position away from the rotor blade by 1 mm, moving the probe microphone PB in the circumferential direction at 1 mm intervals, performing the scanning in the circumferential direction, moving the probe microphone PB to the front side in the axial direction (side opposite to the rotor blade) by 1 mm after the scanning in the circumferential direction was completed, and performing the scanning in the circumferential direction again. As described above, the sound pressure in the fixed blade opening portion was measured by repeating the movement in the circumferential direction and the axial direction. In order to reduce the noise in the measurement of each point, the measurement was continuously performed 5 times and the average value was adopted as the sound pressure. FIG. 10 shows an example of the frequency dependence of the measured sound pressure.

From FIG. 10, it was found that 1.8 kHz, which was the discrete frequency sound of the axial fan, and its double wave could be clearly measured even in the inner space of the axial fan. As described above, the sound pressure distribution under strong wind was measured.

By extracting the sound pressure of the basic discrete frequency sound at each measurement point and plotting the sound pressure at each measurement position, a spatial distribution of the sound pressure at the discrete frequency (1.8 kHz) was shown (FIG. 6). Note that the sound pressure of the discrete frequency sound was removed by regarding the peripheral sound pressure as the sound pressure due to the wind noise as the background to obtain the sound pressure of the discrete frequency sound.

An area indicated as the inside of the fan in FIG. 6 was inside the fixed blade opening portion, and the blades of the fixed blade were present at both ends in the circumferential direction. From FIG. 6, it was found that there was a coarse/fine distribution of the sound pressure over 30 dB in the circumferential direction of the axial fan. The sound pressure was high in the vicinity of the fixed blade and the sound pressure was low in the vicinity of the center of the fixed blade opening portion. As described above, the sound pressure distribution in the circumferential direction of the inner space of the axial fan was determined by actual measurement.

Example 1

According to the measurement results described above, the air column resonator was connected to the position of the axial fan in the circumferential direction at which the sound pressure was high (in the vicinity of the fixed blade (circumferential direction, axial direction)=(3 mm, 13 mm)). Note that this position was the position equal to or more than $P_{max}-0.4\times(P_{max}-P_{min})$ with respect to the maximum value $P_{max}$ and the minimum value $P_{min}$ of the sound pressure in the sound pressure distribution in the circumferential direction. Since, in the axial fan, the number of blades of the fixed blade was five and the number of blades of the rotor blade was seven, there were also five fixed blade opening portions. Therefore, one air column resonator was connected to each of the five fixed blade opening portions.

Figure 11:
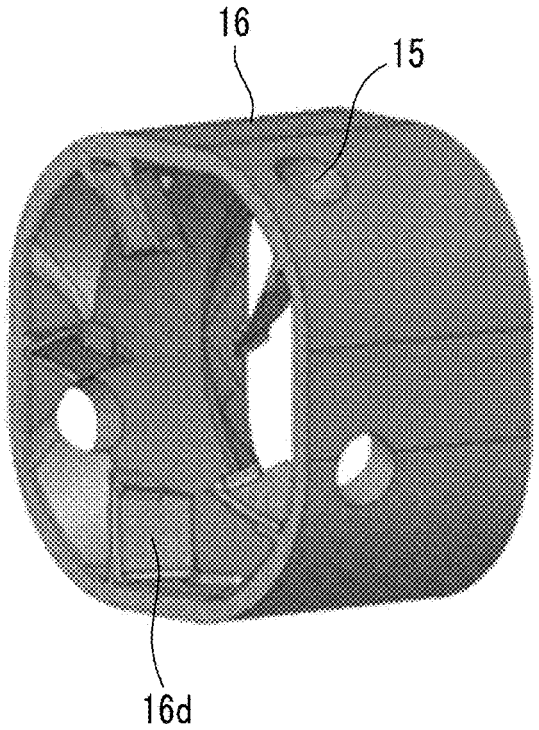
FIG. 11 is a perspective view showing a shape of the manufactured casing.

As shown in a CAD model of FIG. 11, the casing was provided with an opening (through-hole) having a diameter of 10 mm at a portion into which the air column resonator was inserted.

As the silencer, an air column resonance pipe made of vinyl chloride and having one-sided closed pipe (the outer diameter was 10 mm, the inner diameter was 6 mm, and the inner length (resonance pipe length) was 48 mm) was used. The resonance frequency of this air column resonator was 1670 Hz. By inserting this air column resonator into each through-hole of the casing, the blower with the silencer having five air column resonators was manufactured. The end part of the air column resonator was adjusted not to protrude to the inner space of the axial fan. In a state of protruding to the inside of the fan, the wind hits the corners of the air column resonator and the wind noise was likely to be generated, so that it was desirable not to block the air duct.

Comparative Example 1

In Comparative Example 1, the axial fan described above was used as a single unit. That is, the configuration was adopted in which the silencer was not provided.

Comparative Example 2

According to the measurement results described above, the same air column resonator as the air column resonator used in Example 1 was connected to the position of the axial fan in the circumferential direction at which the sound pressure was low (in the vicinity of the fixed blade (circumferential direction, axial direction)=(12 mm, 13 mm)) to manufacture the blower with the silencer. Note that this position was the position equal to or more than $P_{max}+0.4\times(P_{max}-P_{min})$ with respect to the maximum value $P_{max}$ and the minimum value $P_{min}$ of the sound pressure in the sound pressure distribution in the circumferential direction. Similar to Example 1, one air column resonator was connected to each of the five fixed blade opening portions.

[Evaluation]

The noise volumes of the manufactured blowers with silencers in examples and comparative examples (comparative example 1 was a single axial fan) were measured.

Figure 12:
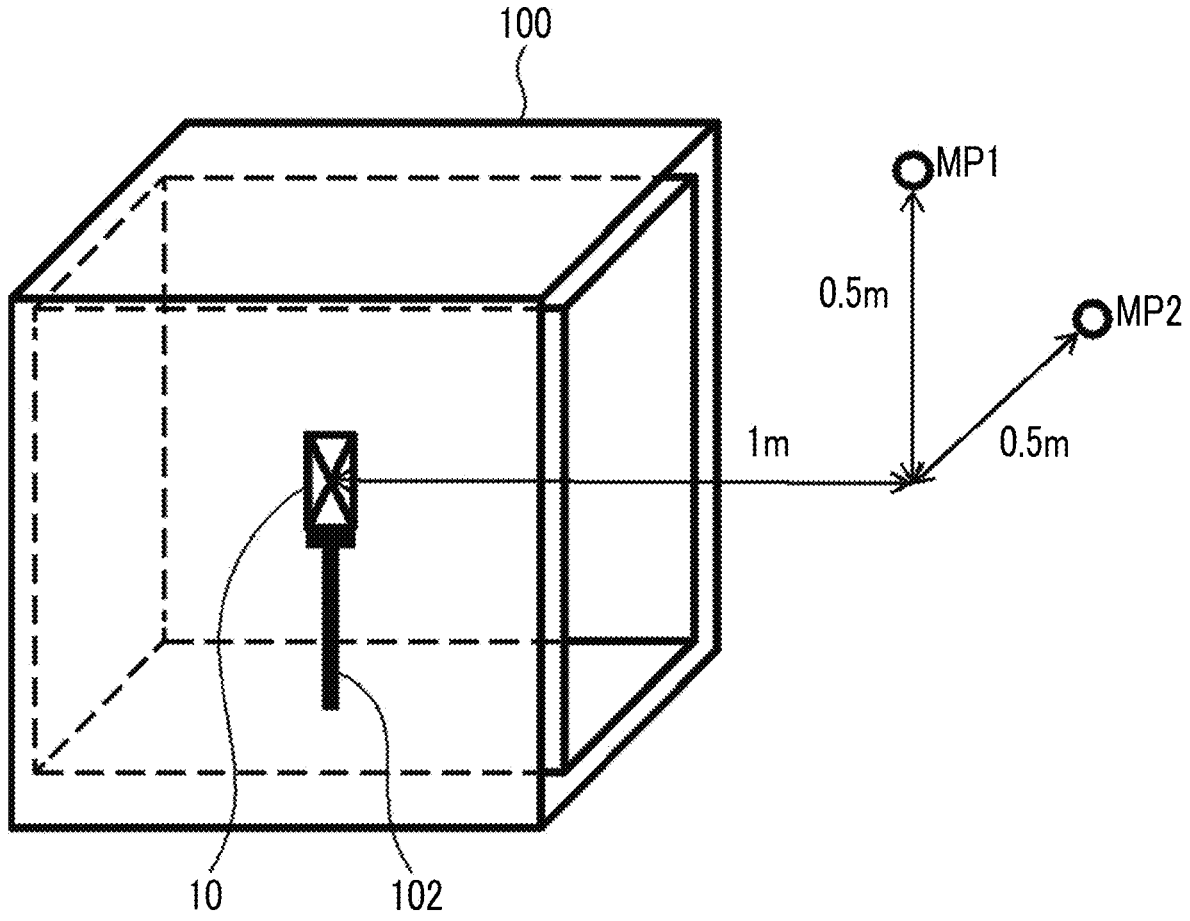
FIG. 12 is a diagram for describing a measuring method of a noise volume in Examples.

As shown in FIG. 12, a 1 m square box having two empty front and rear surfaces was manufactured by an acrylic plate having a thickness of 10 mm, and a sound absorbing urethane (not shown) having a thickness of 10 cm was attached to the entire inner side surface to manufacture a measurement box 100. At the center of the measurement box 100, the blower 10 with the silencer was disposed using a base 102. The direction of the air flow generated by the axial fan was disposed in accordance with an open surface of the measurement box 100. A microphone MP1 (4152N, manufactured by ACO Co., Ltd.) was disposed at a position away from the axial fan to the exhaust side in the axial direction by 1 m and to the upper side in the vertical direction by 0.5 m, and a microphone MP2 (4152N, manufactured by ACO Co., Ltd.) was disposed at a position away to the exhaust side in the axial direction by 1 m and in the horizontal direction by 0.5 m.

Figure 13:
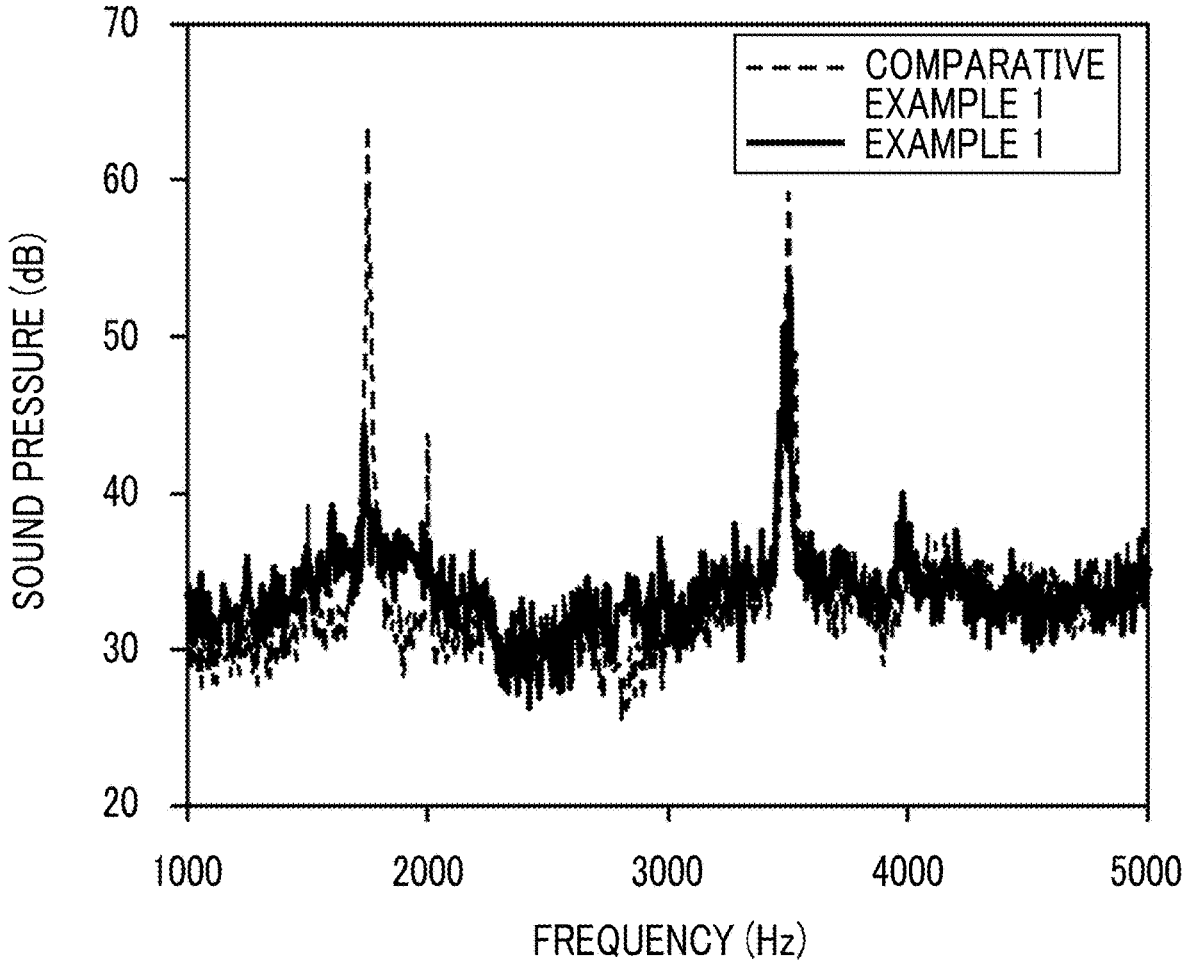
FIG. 13 is a graph showing a relationship between the frequency and the sound pressure.
Figure 14:
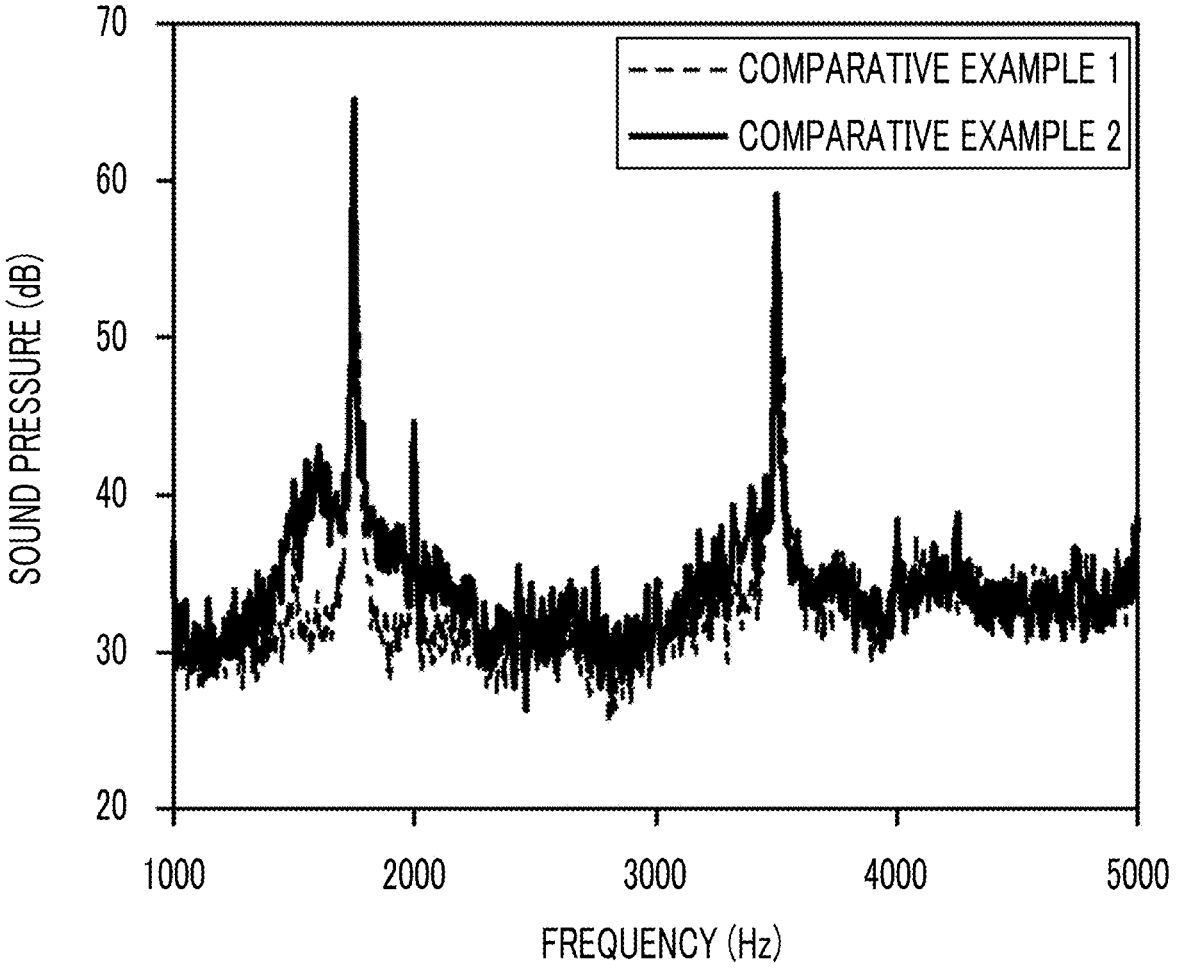
FIG. 14 is a graph showing a relationship between the frequency and the sound pressure.

The fan was operated and the noise volume was evaluated using the average value of the sound pressures measured by the two microphones. FIGS. 13 and 14 show the results.

From the comparison between Example 1 and Comparative Example 1 in FIG. 13, it was found that a large silencing effect (about 20 dB) could be obtained for the discrete frequency sound of about 1.80 kHz in the vicinity of the resonance frequency. Further, it was found that the silencing effect of higher-order second-order discrete frequency sounds could be obtained. That is, it was found that the silencing effect could be obtained at a higher frequency in addition to at the frequency in the vicinity of the resonance frequency of the resonator, and it was found that a peculiar effect that was advantageous for silencing the axial fan was exhibited. Therefore, by connecting the resonator to the position of the axial fan in the circumferential direction at which the sound pressure was high, a high silencing effect could be obtained for a high air volume fan.

In addition, it was confirmed that the blower with the silencer of Example 1 had no change in the wind speed and the air volume as compared with the original axial fan (Comparative Example 1).

From the comparison between Comparative Example 1 and Comparative Example 2 in FIG. 14, it was found that, in Comparative Example 2, although the same silencer as in Example 1 was used, the discrete frequency sound was not silenced, but rather amplified by about 1 dB. That is, it was found that, in a case in which the resonator was connected to the position of the axial fan in the circumferential direction at which the sound pressure was low, not only the silencing effect could not be obtained but also the sound was amplified. In addition, in a case of the configuration of Comparative Example 2, it was found that there was no silencing effect of the high-order discrete frequency sound. In addition, it was found that the amplification amount of the sound (mainly the wind noise component) amplified at a frequency in the vicinity of the resonance frequency of the air column resonator was larger than that of Example 1.

As described above, it was found that, even in a case in which the same resonator was used, the silencing effect differed depending on the connection position of the axial fan in the circumferential direction, a high silencing effect could be obtained by connecting the resonator to the position in the circumferential direction at which the sound pressure was high, and the silencing effect could not be obtained in a case in which the resonator was connected to the position at which the sound pressure was low. Therefore, it was found that, in a case in which the silencer was disposed at all positions of the axial fan in the circumferential direction, the position at which the sound was amplified was included, so that a high silencing effect could not be obtained.

Example 2

Instead of the air column resonator used in Example 1, an L-shaped air column resonator (made of ABS resin, the one-sided closed pipe structure, 48 mm of the flow passage length (resonance pipe length)) with the opening portion positioned at a position bent 90° with respect to the resonance pipe was used. The resonance frequency of this air column resonator was 1790 Hz. The air column resonator was attached to the through-hole of the casing of the axial fan such that an extending direction of the resonance pipe was the axial direction. Since the casing was the same as in Example 1, the air column resonator was connected to the position of the axial fan in the circumferential direction at which the sound pressure was high (in the vicinity of the fixed blade (circumferential direction, axial direction)=(3 mm, 13 mm)).

By attaching the L-shaped air column resonator as the air column resonator to the axial fan such that the extending direction of the resonance pipe was the axial direction, the area of the entire blower with the silencer viewed from the axial direction could be made smaller and more compact than in Example 1.

[Evaluation]

Figure 15:
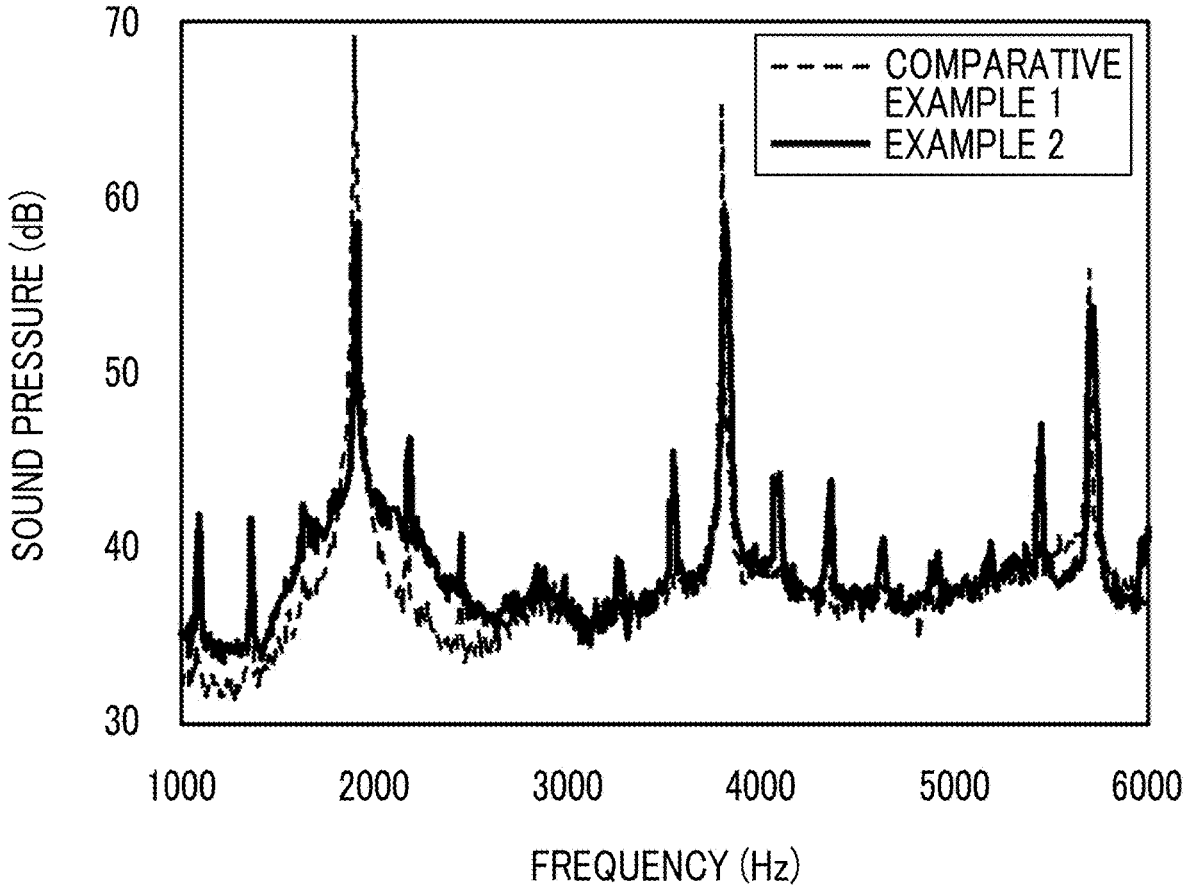
FIG. 15 is a graph showing a relationship between the frequency and the sound pressure.

The noise volume was measured by the same method as described above. FIG. 15 shows the results. The current value applied to the fan was made larger than in Example 1, and the operation was performed at higher speed and higher air volume.

From the comparison between Example 1 and Comparative Example 1 in FIG. 15, it was found that a large silencing effect could be obtained for the discrete frequency sound of about 1.9 kHz in the vicinity of the resonance frequency. Further, it was found that the silencing effect of higher-order second-order and third-order discrete frequency sounds could be obtained. Therefore, it was found that even the L-shaped air column resonator with a compact size exhibited the silencing effect.

In addition, it was confirmed that the blower with the silencer of Example 2 had no change in the wind speed and the air volume as compared with the original axial fan (Comparative Example 1).

Example 3

The blower with the silencer having the film type resonator as the silencer was manufactured as follows.

A circular frame (material: acrylic, frame thickness of 2.5 mm) having an opening with a diameter of 15 mm and a height of 8 mm was manufactured as the frame. As a film of a PET film having a thickness of 50 μm, the film type resonator was manufactured by fixing to the opening of the frame with double-sided tape.

Figure 16:
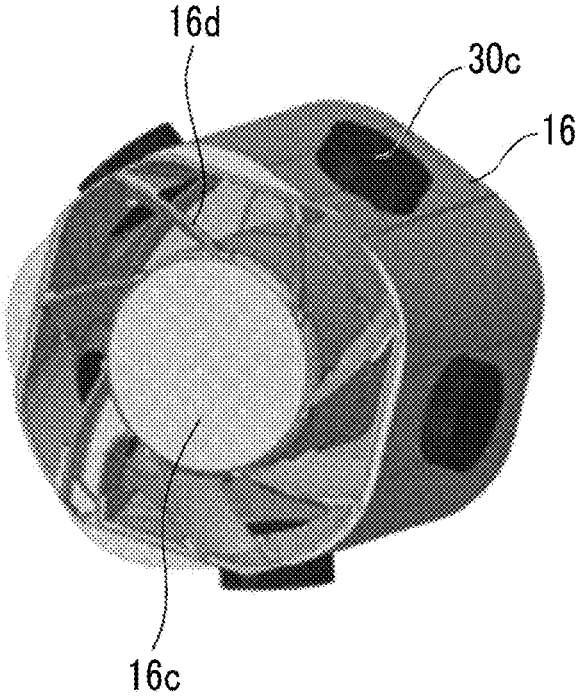
FIG. 16 is a perspective view showing the shape of the manufactured blower with the silencer.

Since an inner wall of the casing of the original axial fan was bent, as the casing having a flat surface was manufactured as the casing to which the film type resonator was attached. FIG. 16 shows a 3D model of the casing 16 and the film type resonator 30*c* to be attached. The connection position of the film type resonator was set in the vicinity of the fixed blade corresponding to Example 1.

The casing was removed from the original axial fan, the manufactured casing was attached thereto, and the film type resonator was attached to the casing to manufacture the blower with the silencer.

Comparative Example 3

A casing having the same structure as the casing of Example 3 and having no opening for connecting the film type resonator was manufactured, and the casing was removed from the original axial fan and the manufactured casing was attached thereto to manufacture the axial fan.

In Comparative Example 3, since the shape of the casing was changed, the wind speed was 10% lower than that of Comparative Example 1 at the same rotation speed as the original axial fan (Comparative Example 1).

[Evaluation]

Figure 17:
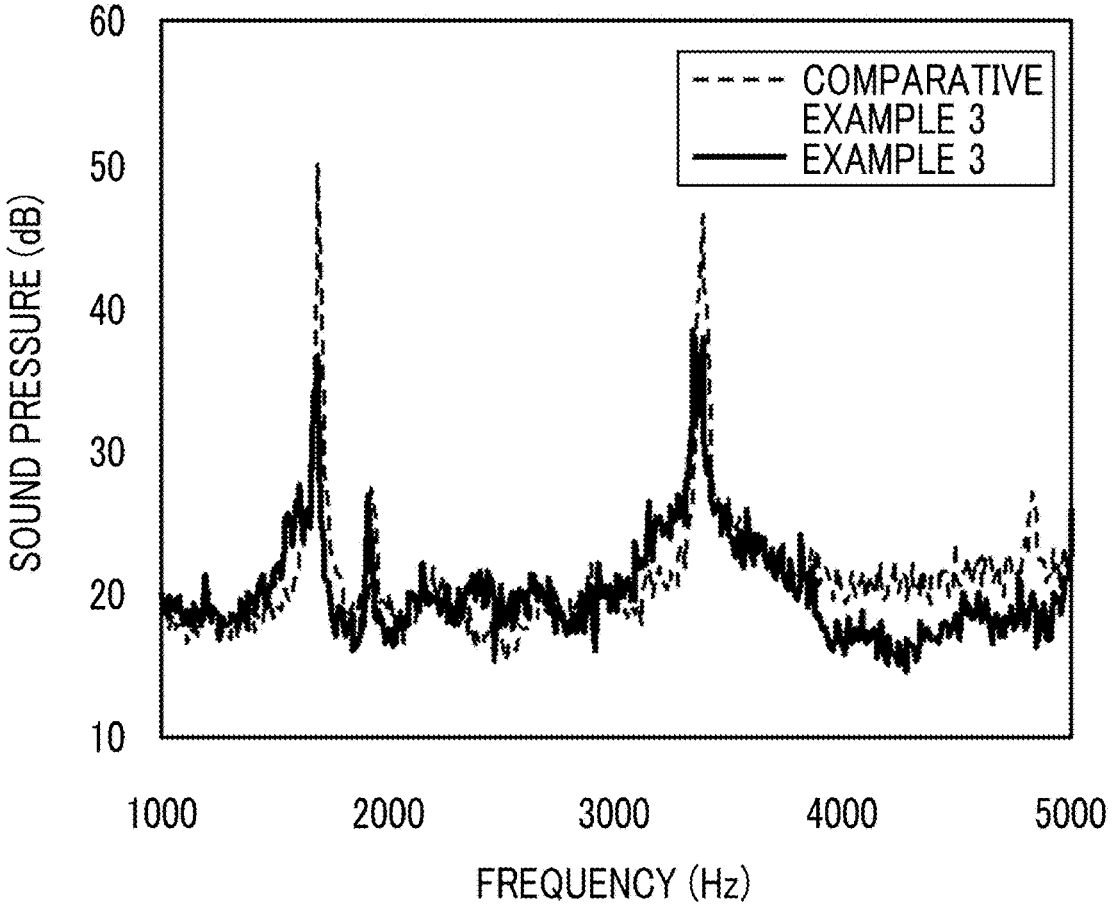
FIG. 17 is a graph showing a relationship between the frequency and the sound pressure.

For Example 3 and Comparative Example 3, the noise volume was measured by the same method as described above. FIG. 17 shows the results.

From the comparison between Example 3 and Comparative Example 3 in FIG. 17, it was found that a large silencing effect could be obtained for the discrete frequency sound. Further, it was found that the silencing effect of higher-order second-order discrete frequency sounds could be obtained.

[Simulation 1]

In the following, the relationship between the difference in the number of blades between the fixed blade and the rotor blade and the sound pressure distribution in the circumferential direction of the axial fan was examined by the simulation. The finite element method calculation software COMSOL Multiphysics (ver. 5.3, COMSOL Inc.) was used for the simulation.

Figure 18:
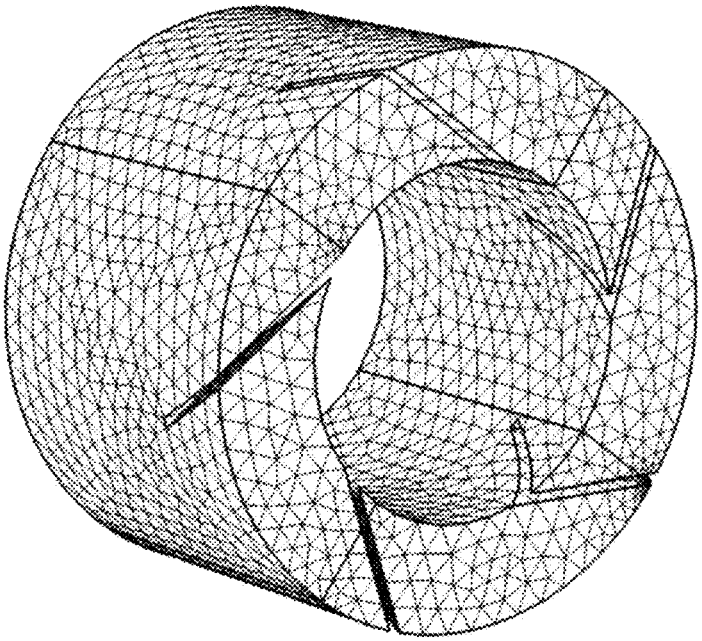
FIG. 18 is a diagram of a model of an inner space of the blower with the silencer in simulation.

A model of the inner space of the axial fan as shown in FIG. 18 was created and the sound source was set to reproduce the phase of the fan. Five fixed blades and seven rotor blades were used in accordance with the axial fan used in examples.

Figure 19:
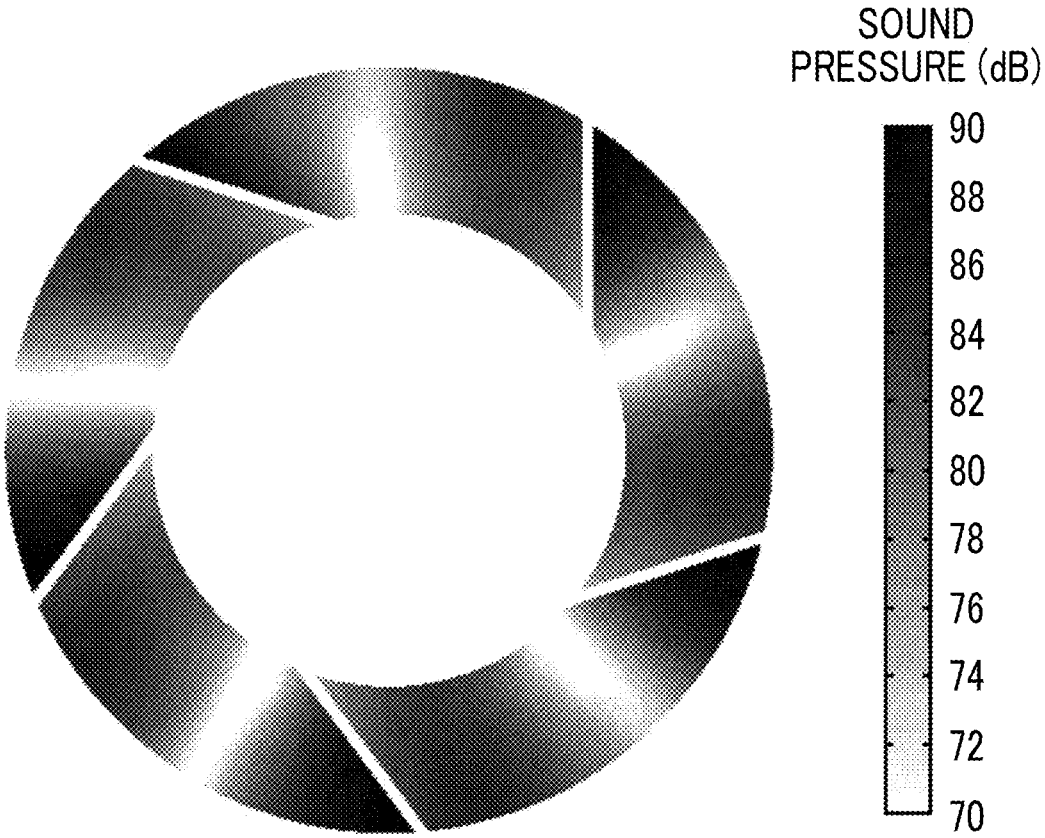
FIG. 19 is a diagram showing the sound pressure distribution.
Figure 20:
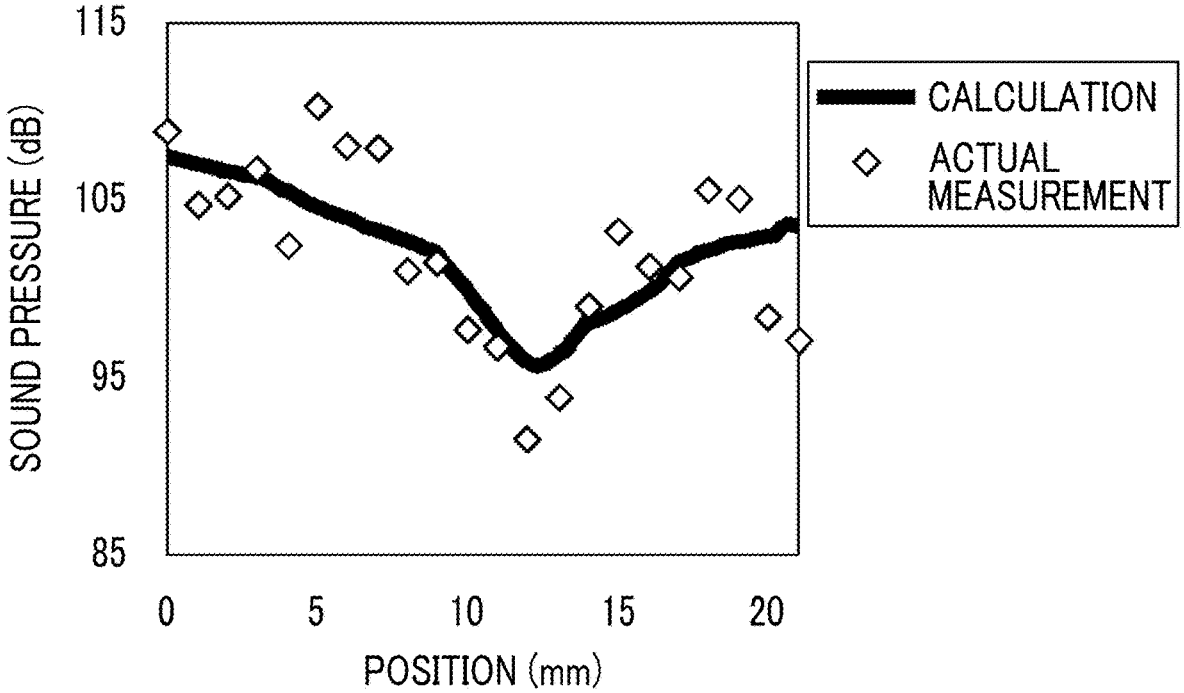
FIG. 20 is a graph showing a relationship between a position and the sound pressure.

Using this model, the sound pressure distribution in the inner space of the axial fan was calculated by the simulation. FIG. 19 shows the calculation result of the sound pressure distribution at the position of the fixed blade in the axial direction. It was found that the sound pressure was high on the periphery of the fixed blade (white part in FIG. 19) and the sound pressure was low in the vicinity of the center of the fixed blade opening portion. This results were matched with the tendency of the measurement results in FIG. 6. In addition, FIG. 20 shows a graph comparing the sound pressure distribution of a black dotted line portion in FIG. 19 with the actually measured value. From FIG. 20, it was found that this simulation was quantitatively matched with the actually measured value.

Figure 21:
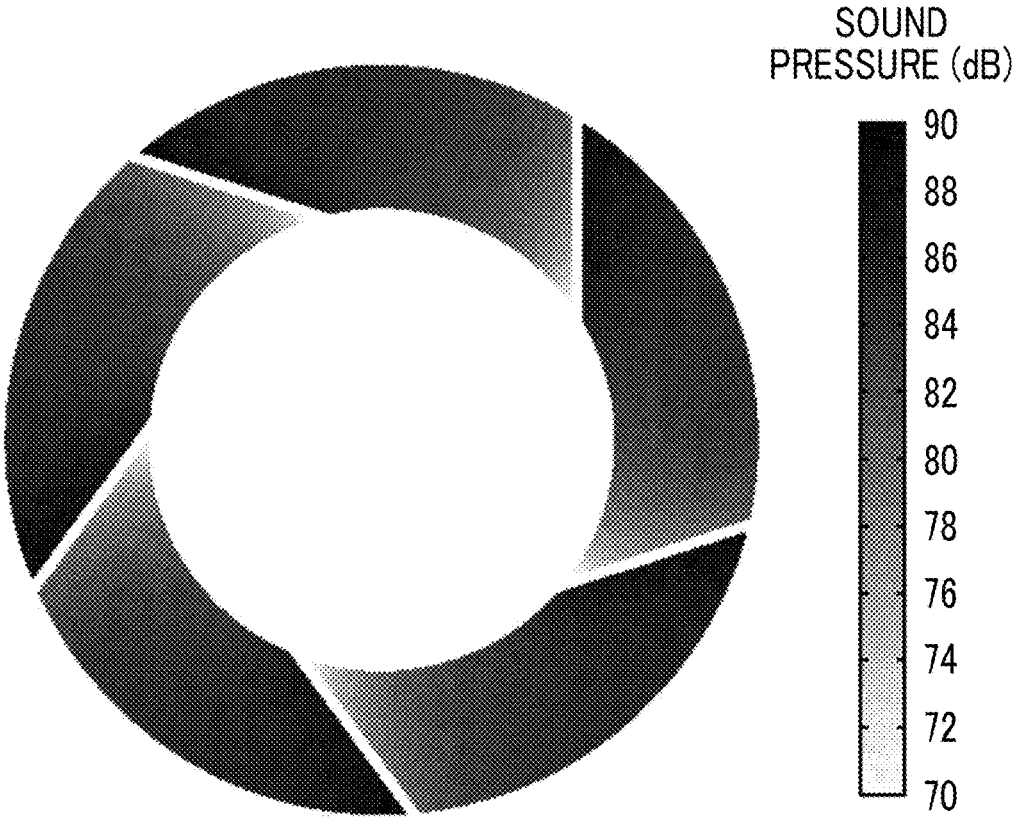
FIG. 21 is a diagram showing the sound pressure distribution.
Figure 22:
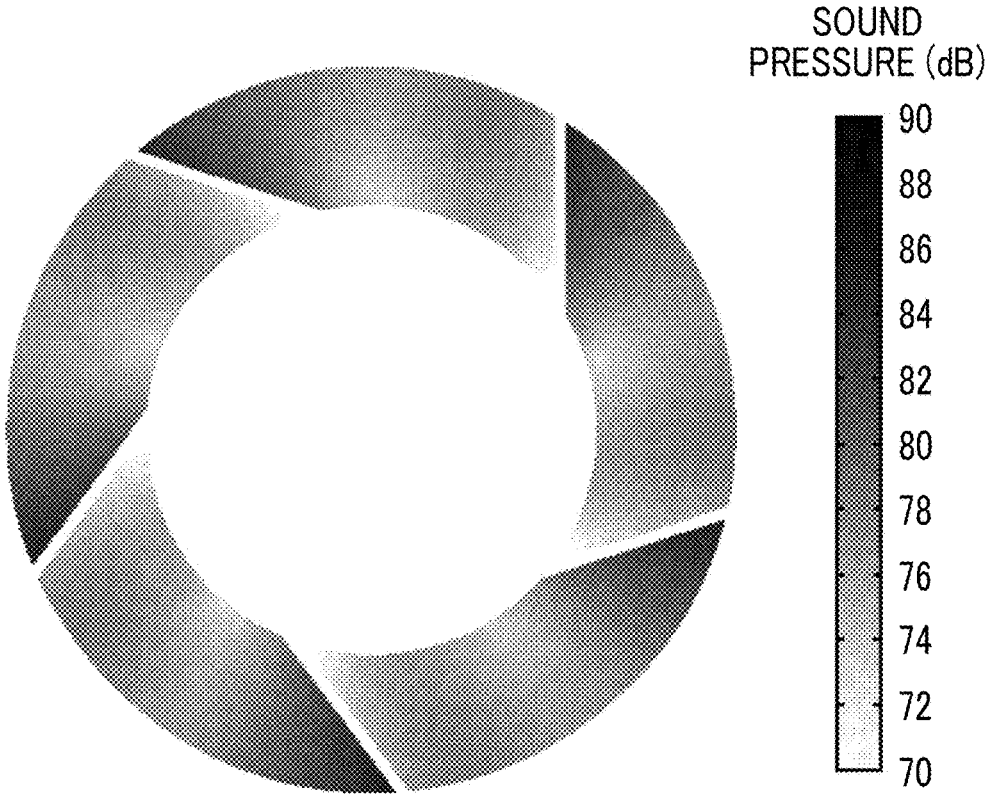
FIG. 22 is a diagram showing the sound pressure distribution.
Figure 23:
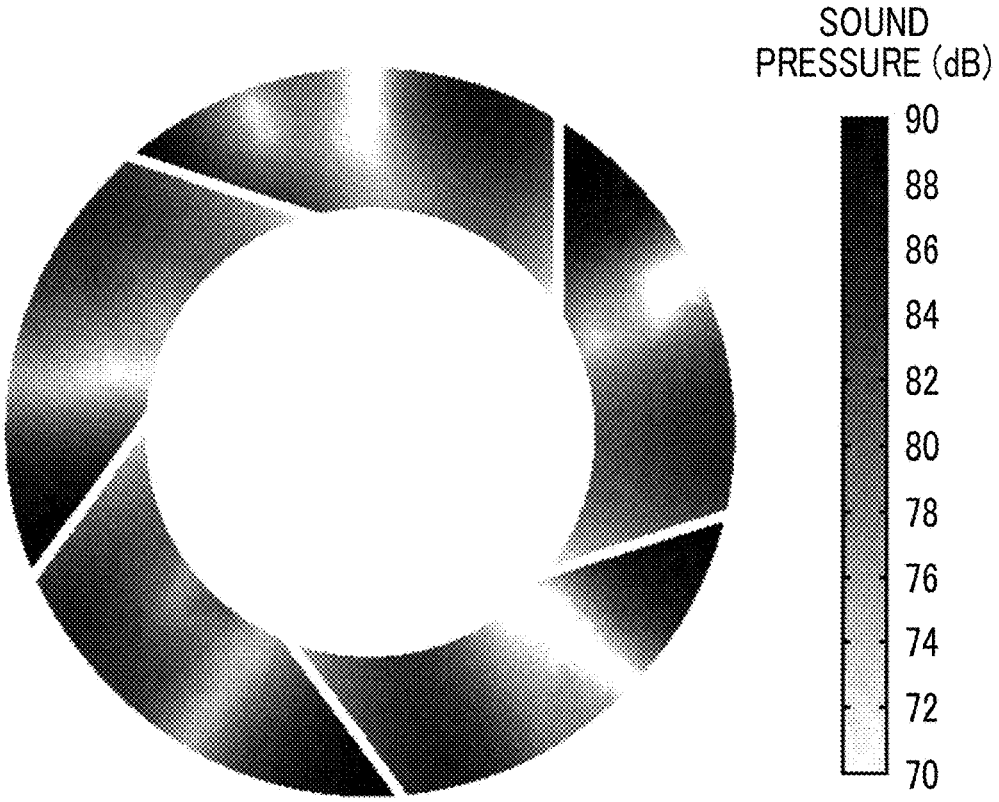
FIG. 23 is a diagram showing the sound pressure distribution.

In this simulation, the number and shape of the fixed blades were set to the same, and models in a case in which the number of blades of the rotor blade was 3, 5, and 9 were created, and the sound pressure distribution in the inner space of the axial fan was calculated. The result in a case in which the number of blades of the rotor blade was 3 is shown in FIG. 21, the result in a case in which the number of blades was five is shown in FIG. 22, and the result in a case in which the number of blades is nine is shown in FIG. 23. In each figure, a display range was set to 20 dB.

From the comparison of FIGS. 19 and 21 to 23, it was found that the difference between the position at which the sound pressure was high and the position at which the sound pressure was low in the fixed blade opening portion was increased in a case in which the number of blades of the rotor blade was equal to or more than 5, which was the same as the number of blades of the fixed blade, and the difference in the sound pressure was increased as the number of blades of the rotor blade was increased. It was considered that the effect was likely to appear by connecting the silencer only at the position at which the sound pressure was high in a case in which the difference in the sound pressure was large, so it was found that it was desirable that the number of blades of the rotor blade be equal to or more than the number of blades of the fixed blade. Note that, even in a case in which the number of blades of the rotor blade was three, the sound pressure was high in the vicinity of the fixed blade, so even in a case in which the number of blades of the rotor blade was less than the number of blades of the fixed blade, the silencing effect could be obtained as long as an appropriate position is selected.

Figure 24:
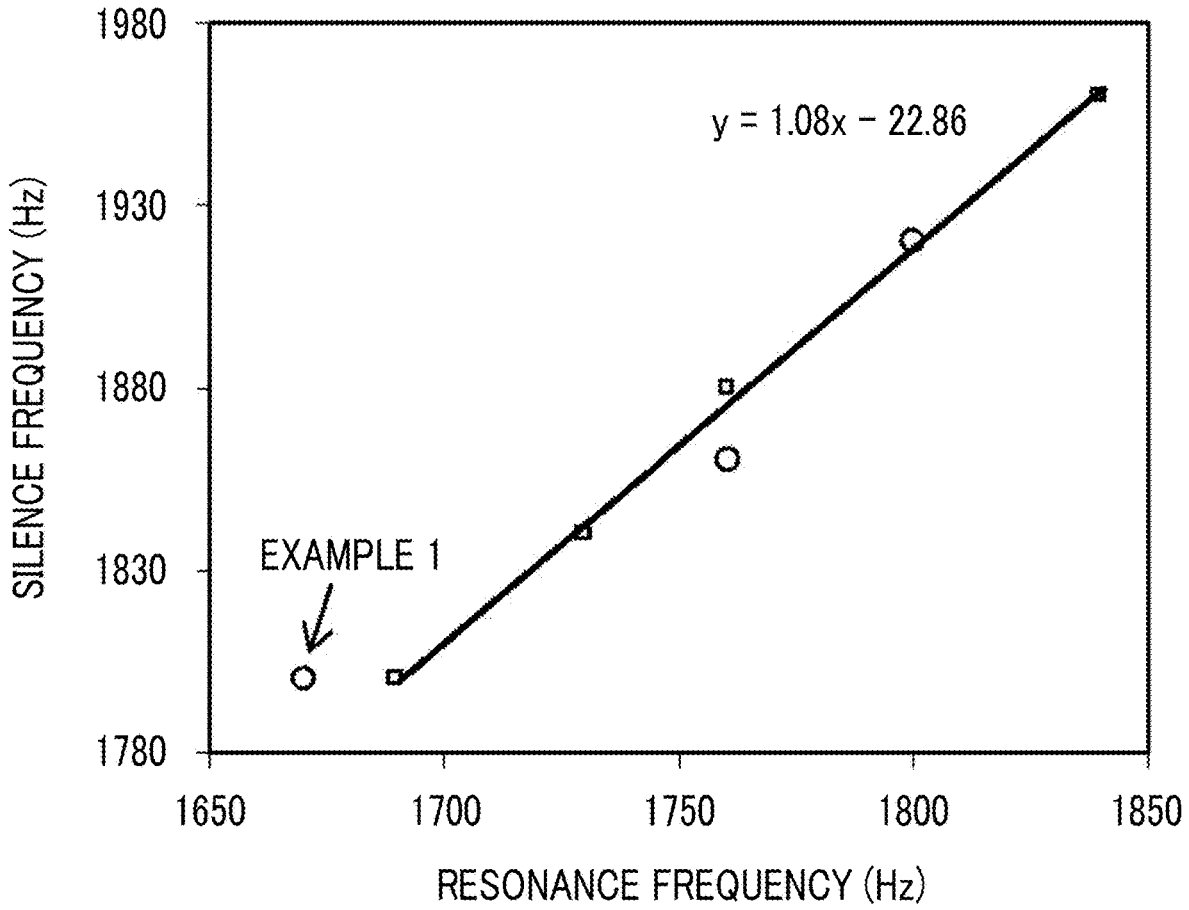
FIG. 24 is a graph showing a relationship between a resonance frequency and a silencing frequency.

In the simulation model using the COMSOL, the model in which the air column resonator was attached at the same position as in Example 1 was created. The length of the air column resonator was changed by 1 mm from 44 mm to 48 mm, and the resonance frequency of the attached resonator and the silencing frequency in the system (blower with the silencer) were calculated. FIG. 24 shows the results by squares. It was found that the relationship between these two frequencies could be approximated by a straight line, and that the relationship of silencing frequency=resonance frequency×1.08, that is, resonance frequency=silencing frequency×0.926 was established.

The silencing effect of the fan was actually measured in the same manner as in Example 1 by using three levels of the air column resonators including Example 1 and having different lengths. FIG. 24 shows the results by circles. From FIG. 24, the actual measurement result had an error of 1.2% at the maximum from the calculation result.

Therefore, it was found that, in both the actual measurement and the calculation, it was most desirable that the resonance frequency of the resonator be present on the lower frequency side than the silencing frequency and the frequency ratio be about 0.93 under the silencing conditions.

Here, regarding the method of determining the resonance frequency of the resonator, it could be determined as the frequency at which the radiated sound volume was maximized in the vicinity of the silencing frequency in the calculation.

In the actual measurement, for example, the acoustic measurement was performed by changing the rotation speed and the air volume by changing the amount of current input to the fan. At any current level, the same frequency band in which the sound was amplified and the sound pressure had the maximum value was present in the vicinity of the silencing frequency by using the amplification of the wind noise by the resonator as the mechanism. The frequency at which this sound pressure maximum value could be determined as the resonance frequency of the resonator.

From the results described above, the effect of the present invention is clear.

EXPLANATION OF REFERENCES

10: blower with silencer
12: axial fan
14: motor
15: through-hole
16: casing
16*a*: support portion
16*b*: outer frame portion
16*c*: cover portion
16*d*: fixed blade
16*e*: hole
17: inner space
18: rotor blade
20: shaft portion
22: blade
30: silencer
30*a*: Helmholtz resonator
30*b*: air column resonator
30*c*: film type resonator
32: case
34: opening portion
36: inner space
40: frame
42: film
44 back space
100: measurement box
102: base
PB: probe
MP1: microphone
MP2: microphone

What is claimed is:

1. A blower with a silencer, the blower comprising:
an axial fan that includes a casing having an inner space that penetrates in one direction, and a rotor blade disposed in the inner space of the casing; and
a silencer that is disposed at a position connected to the inner space of the axial fan,
wherein the axial fan has a plurality of fixed blades,
the axial fan has a sound pressure distribution having, in a plurality of fixed blade opening portions which are each formed between the adjacent fixed blades, a position at which a sound pressure is high and a position at which the sound pressure is low in a circumferential direction in the inner space during driving,
the silencer is connected to the position at which the sound pressure is high and is not connected to the position at which the sound pressure is low in the sound pressure distribution within at least one of the plurality of fixed blade opening portions, and
the silencer is not disposed at the position at which the sound pressure is low in all of the plurality of fixed blade opening portions.

2. The blower with a silencer according to claim 1,
wherein the silencer is a resonator.

3. The blower with a silencer according to claim 2,
wherein the resonator has a flow passage communicating with the inner space of the axial fan.

4. The blower with a silencer according to claim 2,
wherein, in a case in which a resonance frequency of the resonator is denoted by $f_0$ and at least one frequency of a discrete frequency sound caused by the rotor blade of the axial fan is denoted by $f_n$, the resonance frequency $f_0$ of the resonator is in a range of $0.8\times f_n$ to $1.1\times f_n$.

5. The blower with a silencer according to claim 3,
wherein, in a case in which a resonance frequency of the resonator is denoted by $f_0$ and at least one frequency of a discrete frequency sound caused by the rotor blade of the axial fan is denoted by $f_n$, the resonance frequency $f_0$ of the resonator is in a range of $0.8\times f_n$ to $1.1\times f_n$.

6. The blower with a silencer according to claim 4,
wherein, in a case in which the resonance frequency of the resonator is denoted by $f_0$ and at least one frequency of the discrete frequency sound caused by the rotor blade of the axial fan is denoted by $f_n$, the resonance frequency $f_0$ of the resonator is in a range of $0.9 \times f_n$ to $0.95 \times f_n$.

7. The blower with a silencer according to claim 5, wherein, in a case in which the resonance frequency of the resonator is denoted by $f_0$ and at least one frequency of the discrete frequency sound caused by the rotor blade of the axial fan is denoted by $f_n$, the resonance frequency $f_0$ of the resonator is in a range of $0.9 \times f_n$ to $0.95 \times f_n$.

8. The blower with a silencer according to claim 4, wherein the resonator having the resonance frequency $f_0$ in the range of $0.8 \times f_n$ to $1.1 \times f_n$ with respect to each of two or more discrete frequency sounds is provided.

9. The blower with a silencer according to claim 5, wherein the resonator having the resonance frequency $f_0$ in the range of $0.8 \times f_n$ to $1.1 \times f_n$ with respect to each of two or more discrete frequency sounds is provided.

10. The blower with a silencer according to claim 6, wherein the resonator having the resonance frequency $f_0$ in the range of $0.8 \times f_n$ to $1.1 \times f_n$ with respect to each of two or more discrete frequency sounds is provided.

11. The blower with a silencer according to claim 7, wherein the resonator having the resonance frequency $f_0$ in the range of $0.8 \times f_n$ to $1.1 \times f_n$ with respect to each of two or more discrete frequency sounds is provided.

12. The blower with a silencer according to claim 1, wherein the silencer is disposed at a position that does not overlap with a region formed by rotation of the rotor blade as viewed from an axial direction of the axial fan.

13. The blower with a silencer according to claim 1, wherein the silencer is disposed at each of two or more positions at which the sound pressure is high in the sound pressure distribution of at least one discrete frequency sound caused by the rotor blade of the axial fan in the circumferential direction.

14. The blower with a silencer according to claim 1, wherein the silencer is disposed in all the fixed blade opening portions.

15. The blower with a silencer according to claim 1, wherein at least one silencer is disposed at a position within 25% of a distance between the fixed blades, from the fixed blade.

16. The blower with a silencer according to claim 14, wherein at least one silencer is disposed at a position within 25% of a distance between the fixed blades, from the fixed blade.

17. The blower with a silencer according to claim 1, wherein the number of blades of the rotor blade is more than the number of blades of the fixed blade.

* * * * *